US007112000B2

(12) United States Patent
Kurashina et al.

(10) Patent No.: US 7,112,000 B2
(45) Date of Patent: Sep. 26, 2006

(54) CONTROLLING A TAPE PROCESSING APPARATUS FOR EMBOSSING ON A TAPE TO BE PROCESSED A RECOGNIZABLE BRAILLE AND FOR PRINTING INK CHARACTERS

(75) Inventors: Hiroyasu Kurashina, Matsumoto (JP); Junichi Kikuchi, Saitama (JP); Takayuki Uehara, Koshigaya (JP); Makoto Takada, Shiojiri (JP); Seiji Tanaka, Toyoshina-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/112,056

(22) Filed: Apr. 21, 2005

(65) Prior Publication Data

US 2005/0238403 A1 Oct. 27, 2005

(30) Foreign Application Priority Data

Apr. 22, 2004 (JP) ..... 2004-126745
Jul. 14, 2004 (JP) ..... 2004-207423
Feb. 22, 2005 (JP) ..... 2005-046220

(51) Int. Cl.
*B41J 3/32* (2006.01)
*B41J 17/00* (2006.01)

(52) U.S. Cl. ..... 400/109.1; 400/188

(58) Field of Classification Search ..... 400/109.1, 400/624, 82, 188, 118; 101/18
See application file for complete search history.

(56) References Cited

U.S. PATENT DOCUMENTS 3,065,299 A * 11/1962 Frey ..... 178/92
3,880,269 A * 4/1975 Carbonneau ..... 400/109.1
3,903,617 A * 9/1975 Evans ..... 434/171
5,193,921 A * 3/1993 Tsukuda et al. ..... 400/109.1
5,222,819 A * 6/1993 Tsukuda et al. ..... 400/109.1
5,529,414 A * 6/1996 Katano et al. ..... 400/636.2
5,627,578 A * 5/1997 Weintraub ..... 347/101
5,853,256 A * 12/1998 Kim ..... 400/624
6,233,857 B1 * 5/2001 Wyckoff et al. ..... 40/596
6,491,215 B1 * 12/2002 Irwin et al. ..... 235/375
6,539,854 B1 * 4/2003 Maeda et al. ..... 101/118
2003/0048326 A1 * 3/2003 Yamasaki et al. ..... 347/41
2004/0076932 A1 * 4/2004 Jeong ..... 434/113
2005/0227207 A1 * 10/2005 McAdams et al. ..... 434/114

FOREIGN PATENT DOCUMENTS

JP 2001-088358 4/2001
JP 2003-182158 7/2003

* cited by examiner

*Primary Examiner*—Minh Chau
*Assistant Examiner*—Wasseem H. Hamdan
(74) *Attorney, Agent, or Firm*—Hogan & Hartson LLP

(57) ABSTRACT

There is provided a method of controlling a tape processing apparatus where braille is embossed at one side in the width direction of a tape with an embossing unit arranged at the one side. The method includes: an embossing-position defining step of defining a braille embossing position in the width direction of the tape; an embossing-data generating step of generating embossing data based on input information and the embossing position; and a braille embossing step of embossing braille on the tape based on the generated embossing data. In the embossing-data generating step, when the embossing position is arranged at one side in the width direction on the same side as the embossing unit, the embossing data is generated for forward embossing. While, when the embossing position is arranged at the other side in the width direction opposite to the embossing unit, the embossing data is generated for reverse embossing.

10 Claims, 22 Drawing Sheets

FIRST PROCESS MODE: INK-CHARACTERS PRINTING → BRAILLE EMBOSSING

SECOND PROCESS MODE: INK-CHARACTERS PRINTING ONLY

THIRD PROCESS MODE: BRAILLE EMBOSSING ONLY

T1 : 24 MM TAPE WIDTH

T2 : 18 MM TAPE WIDTH

T3 : 12 MM TAPE WIDTH

LAYOUT (a-1), FEED TAPE FROM FRONT END
→ EMBOSS BRAILLE DATA IN FORWARD DIRECTION

LAYOUT (a-2), FEED TAPE FROM FRONT END
→ EMBOSSING IS NOT ALLOWED

LAYOUT (a-1), FEED TAPE FROM REAR END
→ EMBOSSING IS NOT ALLOWED

LAYOUT (a-2), FEED TAPE FROM REAR END
→ EMBOSS BRAILLE DATA IN A STATE OF BEING INVERTED

FORWARD EMBOSSING

REVERSE EMBOSSING

FIG. 19

| DEFINE LAYOUT | |
|---|---|
| INK CHARACTERS AND BRAILLE IN PARALLEL | INK CHARACTERS AT UPPER SIDE AND BRAILLE AT LOWER SIDE |
| | BRAILLE AT UPPER SIDE AND INK CHARACTERS AT LOWER SIDE |
| INK CHARACTERS AND BRAILLE OVERLAPPED | BRAILLE LAYOUT AT UPPER SIDE |
| | BRAILLE LAYOUT AT LOWER SIDE |

(Note: Written letters are transliteration of hiragana; raised letters correspond to hiragana, not to alphabets.)

(Note: Written letters are transliteration of hiragana; raised letters correspond to hiragana, not to alphabets.)

CONTROLLING A TAPE PROCESSING APPARATUS FOR EMBOSSING ON A TAPE TO BE PROCESSED A RECOGNIZABLE BRAILLE AND FOR PRINTING INK CHARACTERS

BACKGROUND OF THE INVENTION

1. Field of the Invention

The present invention relates to a method of controlling a tape processing apparatus for embossing on a tape to be processed braille recognizable by visually-impaired people, a tape processing apparatus, and a program.

2. Description of the Related Art

Conventionally, there is known a tape (display tape) processing apparatus in which ink characters (i.e., characters printed with ink; this term is used in this specification as compared with Braille) are printed on a plane-characters printing region with a plane-characters printing means and braille is printed (braille embossing) on a braille printing region with a braille printing means, while a tape material (i.e., tape) is pitch-fed along a tape traveling path. In the braille printing means, there are provided three braille heads for embossing braille on the tape, which act on a braille plate fixed at a given position of the tape traveling path, thereby forming braille on the tape.

In other words, such a tape processing apparatus has a braille embossing region at a given position in the width direction of the tape, which is physically defined according to the relative position between the tape to be fed along the tape traveling path and the braille heads (braille plate). For this reason, the user is not allowed to define the braille embossing region in the width direction of the tape, and a layout of the same is therefore limited.

SUMMARY OF THE INVENTION

In view of the above problem, the present invention has an advantage of providing a method of controlling a tape processing apparatus in which the user can arbitrarily define a braille embossing region in the width direction of a tape without limiting the braille layout thereof, a tape processing apparatus, and a program.

According to one aspect of the present invention, there is provided a method of controlling a tape processing apparatus where braille is embossed at one side in the width direction of a tape with an embossing means arranged at the one side while the tape is being fed along a tape traveling path, the method comprising: an embossing-position defining step of defining a braille embossing position in the width direction of the tape; an embossing-data generating step of generating embossing data for embossing the braille, based on input information and the defined braille embossing position; and a braille embossing step of embossing the braille on the tape based on the generated embossing data; wherein, in the embossing-data generating step, when the defined braille embossing position is arranged at one side in the width direction of the tape on the same side as the embossing means, the embossing data is generated such that braille is forwardly embossed one by one from the front end thereof in the reading direction, and when the defined braille embossing position is arranged at the other side in the width direction of the tape opposite to the embossing means, the embossing data is generated such that inverted braille is reversely embossed one by one from the rear end thereof in the reading direction.

According to another aspect of the present invention, there is provided a tape processing apparatus where braille is embossed at one side in a width direction of a tape while the tape is being fed along a tape traveling path, the apparatus comprising: an embossing means arranged at one side in the width direction of the tape, for embossing braille at the one side; an embossing-position defining means for defining a braille embossing position in the width direction of the tape; an embossing-data generating means for generating embossing data based on input information and the defined braille embossing position; and an embossing controlling means for controlling the embossing means based on the generated embossing data; wherein, with the embossing-data generating means, when the defined braille embossing position is arranged at one side in the width direction of the tape on the same side as the embossing means, the embossing data is generated such that braille is forwardly embossed one by one from the front end thereof in the reading direction, and when the defined braille embossing position is arranged at the other side in the width direction of the tape opposite to the embossing means, the embossing data is generated such that inverted braille is reversely embossed one by one from the rear end thereof in the reading direction.

According to this configuration, forward embossing and reverse embossing can be switched between them based on the positional relationship between the braille embossing position and the embossing means. Note that reverse embossing can be performed by inverting embossing data for forward embossing. Accordingly, even when the relative position in the width direction of the tape between the tape and the embossing means is physically defined in advance, it is possible to define at least two types of braille layouts in the width direction of the tape. The user is thus allowed to select a braille layout according to his/her intended purpose or preference.

Further, when the apparatus employs a configuration in which a braille embossing region is defined at an arbitrary position in the width direction of a tape, forward embossing and reverse embossing can be switched between them based on the positional relationship between the braille embossing region and the embossing means, thereby making it possible to reduce the size of the apparatus. In other words, with a configuration where braille can be embossed at only one side in the width direction of the tape, the other side thereof is embossed through reverse embossing where embossing data is inverted, allowing braille to be embossed over the whole width of the tape. Accordingly, when an feeding position in the width direction of the tape is changed relative to the tape traveling path to arbitrarily define a braille embossing region, the width of the tape traveling path in the width direction thereof can be shortened. Further, when the embossing means is caused to move in the width direction of the tape to arbitrarily define a braille embossing region, the moving range of the embossing means may be reduced.

Preferably, the tape has printed thereon front-and-rear discriminating information for discriminating the front-and-rear thereof in a feeding direction.

According to this configuration, the tape to be embossed in braille has printed thereon the front-and-rear discriminating information for discriminating the front-and-rear of the tape in the feeding direction. Accordingly, when the user manually feeds the tape (with the tape guided by hand) into the braille embossing apparatus, the tape is prevented from being embossed from the wrong side. In addition, when the tape printed with ink characters is used, even if it is found impossible to discriminate ups-and-downs (front-and-rear) of the ink characters (i.e., a sign of arrow or a figure of zero), the front-and-rear discriminating information has been printed on the tape, thereby preventing the user from affixing the same from the wrong side.

Preferably, the method of controlling a tape processing apparatus further comprises a front-and-rear detecting step of detecting the front-and-rear of the tape fed into the tape traveling path, based on the front-and-rear discriminating information, wherein, in the braille embossing step, the braille is prevented from being embossed under conditions where, in the embossing-data generating step, the embossing data is generated such that braille is forwardly embossed, and in the front-and-rear detecting step, the tape is detected to have been fed from the rear end thereof in the reading direction, and in the embossing-data generating step, the embossing data is generated such that braille is reversely embossed, and in the front-and-rear detecting step, the tape is detected to have been fed from the front end thereof in the reading direction.

Preferably, the tape processing apparatus further comprises a front-and-rear detecting means for detecting the front-and-rear of the tape fed into the tape traveling path based on the front-and-rear discriminating information, wherein, with the embossing controlling means, the braille is prevented from being embossed under conditions where the embossing-data generating means generates the embossing data such that braille is forwardly embossed, and the front-and-rear detecting means detects that the tape is fed from the rear end thereof in the reading direction, and the embossing-data generating means generates the braille data such that braille is reversely embossed, and the front-and-rear detecting means detects that the tape is fed from the front end thereof in the reading direction.

According to this configuration, the braille data is embossed in a state of being inverted in cases where the braille embossing region is defined under a basic layout structure and the tape is fed into the tape traveling path from the rear end thereof, or the braille embossing region is defined under one opposite to the basic layout structure and the tape is fed into the tape traveling path from the front end thereof. Accordingly, even if the tape is fed thereinto from the wrong side, braille can be rightly embossed in the defined braille embossing region.

Preferably, in the above description, the method of controlling a tape processing apparatus further comprises: a printing-data generating step of generating printing data for printing ink characters on the tape, based on the input information and the defined braille embossing position; and an ink-characters printing step of printing ink characters on the tape with a printing means based on the generated printing data, prior to the braille embossing step, wherein, in the printing-data generating step, when the defined braille embossing position is arranged at one side in the width direction of the tape on the same side as the embossing means, the printing data is generated such that ink characters are forwardly printed one by one from the front end thereof in the reading direction, and when the defined braille embossing position is arranged at the other side in the width direction of the tape opposite to the embossing means, the printing data is generated such that inverted ink-characters are reversely printed one by one from the rear end thereof in the reading direction.

Preferably, the tape processing apparatus further comprises: a printing means for printing ink characters on the tape, prior to braille embossing with the embossing means; a printing-data generating means for generating printing data for printing ink characters, based on the input information and the defined braille embossing position; a printing controlling means for controlling the printing means, based on the generated printing data; wherein, with the printing-data generating means, when the defined braille embossing position is arranged at one side in the width direction of the tape on the same side as the embossing means, the printing data is generated such that ink characters are forwardly printed one by one from the front end thereof in the reading direction, and when the defined braille embossing position is arranged at the other side in the width direction of the tape opposite to the embossing means, the printing data is generated such that inverted ink-characters are reversely printed one by one from the rear end thereof in the reading direction.

According to this configuration, when the defined embossing position is arranged at one side in the width direction of the tape on the same side as the embossing means, i.e., when forward embossing is performed, forward printing is caused to be performed. While, when the defined embossing position is arranged at the other side in the width direction of the tape opposite to the embossing means, i.e., when reverse embossing is previously performed, reverse printing is caused to be performed. Accordingly, ink-characters printing and braille embossing can be performed in the same direction, thereby achieving a one-pass system where the tape is printed with ink characters and successively embossed in braille. Further, as to a two-pass system where the tape having printed thereon ink characters is embossed in braille, the tape is once cut off and then embossed in braille in the same direction as the ink-characters printing, which eliminates the need to change the direction of the tape or to reversely feed the same to change the direction of performance.

Preferably, the tape traveling path comprises a traveling path for printing along which the tape is fed and printed with ink characters and a traveling path for embossing along which the tape is fed and embossed in braille, and the traveling path for embossing is manually fed with the tape having passed through the traveling path for printing.

According to this configuration, since ink-characters printing and braille embossing are performed in the same direction, a manual feeding direction relative to the tape traveling path for braille embossing is the same as that of the ink-characters printing. Accordingly, even when the user manually feeds the tape printed with ink characters into the tape traveling path for braille embossing, he or she will not have any sense of discomfort.

According to still another aspect of the present invention, there is provided a program which causes a computer to perform each of the means of the tape processing apparatus as described.

According to this configuration, even when an embossing means fixed in position in the width direction of the tape traveling path is employed, it is possible to provide a program for materializing a tape processing apparatus in which an embossing position in the width direction of the tape can be selected according to the user's preference.

BRIEF DESCRIPTION OF THE DRAWINGS

The above and other objects and the attendant features of the present invention will become readily apparent by reference to the following detailed description when considered in conjunction with the accompanying drawings wherein:

FIG. 19 is a table of a layout defining menu;

DETAILED DESCRIPTION OF THE PREFERRED EMBODIMENTS

Hereinafter, a description of a method of controlling a tape processing apparatus, a tape processing apparatus, and a program according to the present invention will be made with reference to the accompanying drawings. According to the present invention, when braille is embossed with an embossing head arranged at a position adjacent to one end in a width direction of a tape traveling path, the arrangement of a braille embossing region on a tape can be selected according to the user's preference without making the embossing head capable of moving in the width direction.

A description will now be made about the method of controlling the tape processing apparatus etc. of the present invention, which is applied to a label forming apparatus for forming braille labels. In the label forming apparatus, both ink-characters printing and braille embossing can be performed, and braille labels recognizable by both visually-normal and visually-impaired people are formed.

Figure 1:
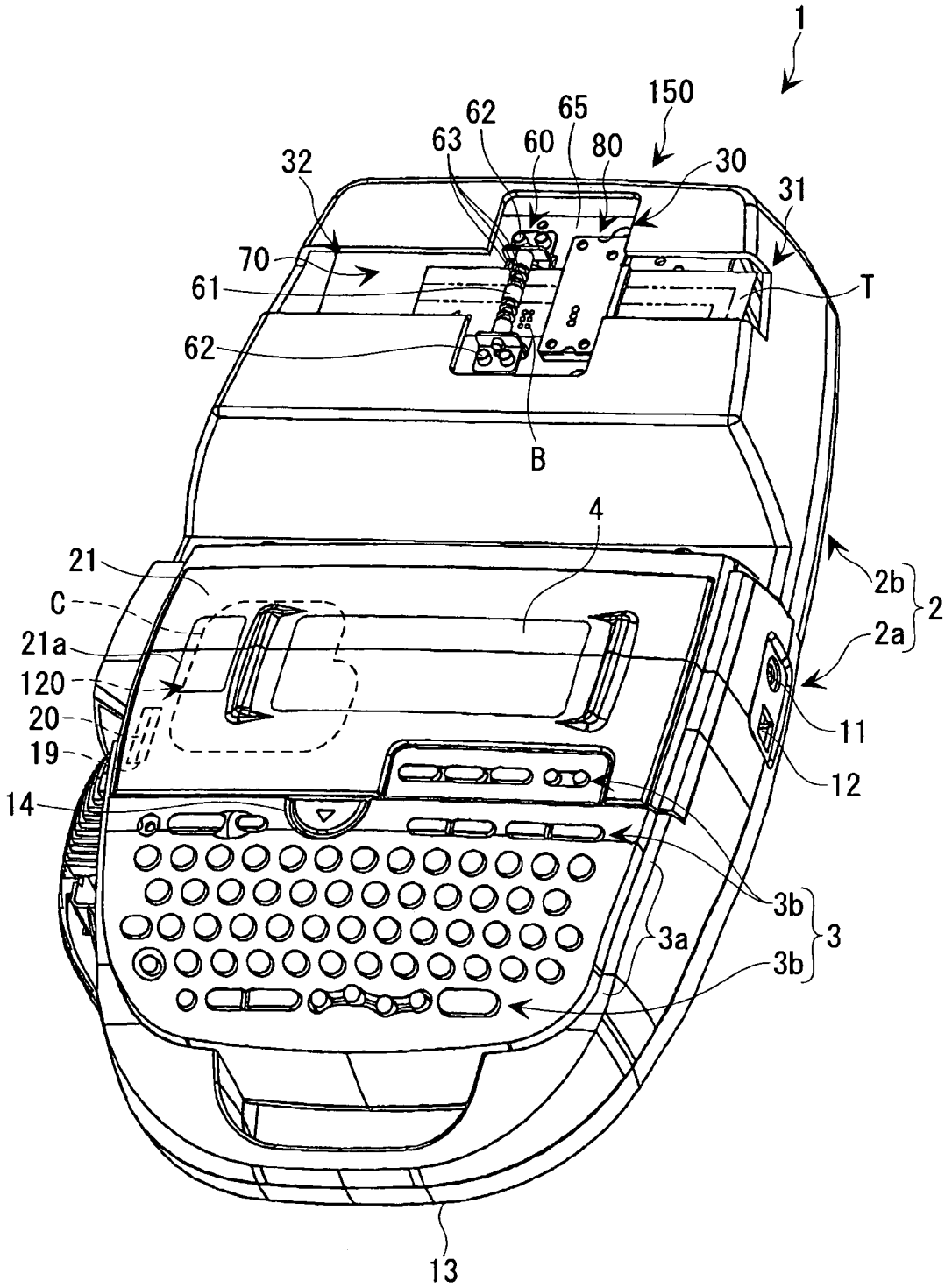
FIG. 1 is an external perspective view of a label forming apparatus according to an embodiment with its cover closed.
Figure 2:
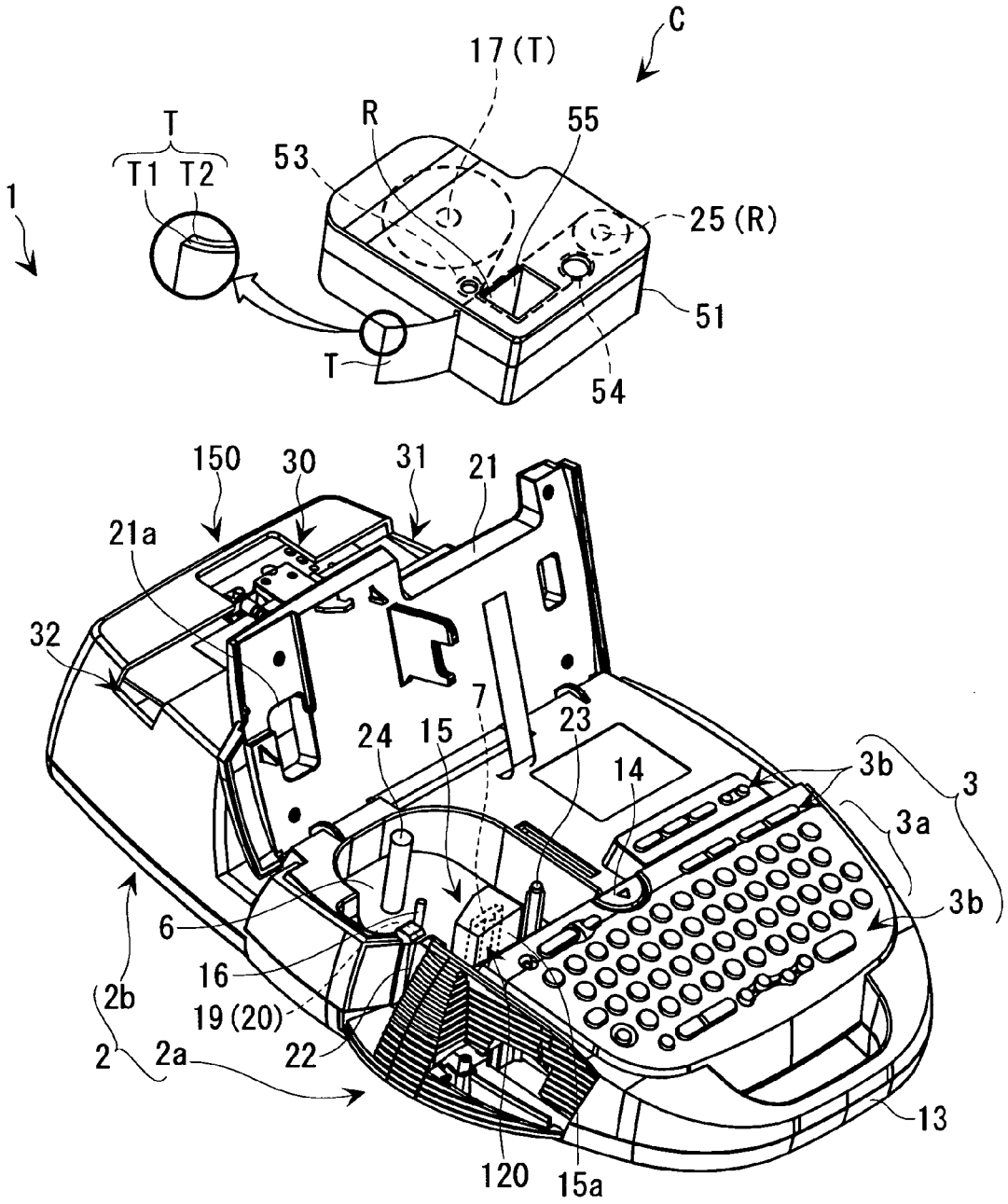
FIG. 2 is an external perspective view of the label forming apparatus with its cover opened.

FIGS. 1 and 2 are external perspective views of the label forming apparatus 1 with its cover closed and opened, respectively. As shown in the figures, the label forming apparatus 1 has an outer shape formed by an apparatus casing 2 with a handle 13, and the casing 2 is integrally formed by a front casing 2*a* and rear casing 2*b*. The front casing 2*a* has an ink-characters printing section 120 where ink characters are printed on a tape T reeled out from a tape cartridge C. The rear casing 2*b* has a braille embossing section 150 where braille is embossed when the user manually feeds the tape T thereinto (i.e., the user holds the tape T with the tips of his/her fingers and then guides the same into the braille embossing section 150).

The front casing 2*a* has a front top face where a keyboard 3 provided with various input keys is arranged, and has a rear top face to which an opening/closing cover 21 is attached. The opening/closing cover 21 has formed therein a rectangular display 4. Inside the opening/closing cover 21, there is provided a recessed cartridge mounting section 6 (ink-characters printing section 120) for mounting the tape cartridge C on the left side thereof. The tape cartridge C is detachably mounted in the cartridge mounting section 6 in a state where the opening/closing cover 21 is opened by depressing a cover opening button 14. In addition, the opening/closing cover 21 has formed therein an discrimination window 21*a* for discriminating the mounting/non-mounting of the tape cartridge C in its closed state.

In the right side of the front casing 2, there are formed a power source supplying port 11 for supplying power source, and a connecting port 12 (interface) for connecting with external devices (not shown) such as a personal computer. When the external devices are connected to the connecting port 12, it is made possible to print ink characters or emboss braille based on character information generated by the external devices.

Further, in the left side of the front casing 2, there is formed a printing-tape ejecting port 22 for communicating the cartridge mounting section 6 with the outside. At the printing-tape ejecting port 22 is arranged a tape cutter 19 for cutting off the tape T fed out from the ink-characters printing section 120 and a half-cutter 20 for half-cutting the tape T. At an end portion of the tape T composed of a recording tape T1 and a releasing tape T2 in a stacked manner, the half-cutter cuts off (half-cuts) only the recording tape T1. A portion printed with ink characters of the tape T ranging from the half-cut position is cut off by the tape cutter 19 and then ejected from the printing-tape ejecting port 22.

The keyboard 3 has arranged therein a characters key group 3*a* and a functions key group 3*b* to direct various operation modes etc. The characters key group 3*a* is used for inputting character information for printing ink characters and/or embossing braille, and is constructed in a full JIS-key arrangement. The functions key group 3*b* is composed of: an execution key for printing ink characters and/or embossing braille; a feeding start key for directing the feed start of the tape T in the braille embossing section 150; an embossing start key for manually embossing braille; a mode selecting key for selecting a process mode for printing ink characters and/or embossing braille; and a layout defining key for defining the arrangement of an ink-characters printing region (printing position) Ep and a braille embossing region (embossing position) Eb (see FIGS. 9A to 9C). Besides, as in the case of a general word processor etc., the functions key group 3*b* is composed of: e.g., a cancel key for canceling processes etc.; a cursor key for moving a cursor; and an enter key for deciding among alternatives on various selection screens or for starting a new line in inputting characters.

Process modes to be selected by the mode selecting key include first, second and third process modes. In the first process mode, ink-characters printing and braille embossing are performed based on inputted character information (see FIG. 8A). In the second process mode, only ink-characters printing is performed based on inputted character information (see FIG. 8B). In the third process mode, braille embossing is performed based on inputted character information (FIG. 8C). The user selects one of the process modes. Note that the following description will be made about a case where the first process mode is selected. In addition, the user uses the layout defining key, which will be described below, to select (define) one of some layouts prepared, according to the tape width of the tape T to be used.

The display 4 is rectangular with sides of approx. 12 cm in width (in X direction) and 5 cm in length (in Y direction) where display image data of 192 dots×80 dots is displayed. The user views the display while he/she inputs character information through the keyboard 3 to form/edit ink-characters data for ink-characters printing and braille data for braille embossing. In addition, various error messages or command contents are displayed on the display to notify the user of the fact.

The cartridge mounting section 6 is provided with: a head unit 15 with a head cover 15*a* including therein a printing head 7 composed of a thermal head; a platen driving shaft 16 arranged at a position opposite to the printing head 7; a reel driving shaft 23 for reeling up an ink ribbon R; and a positioning projection 24 for a tape reel 17. Note that the reel driving shaft and the positioning projection will be describe below. In addition, in the bottom of the cartridge mounting section 6 is embedded a print feeding motor 121 (see FIG. 6) for causing the platen driving shaft 16 and the reel driving shaft 23 to rotate.

The tape cartridge C has a cartridge casing 51 in which are accommodated at an upper central position thereof and at a lower right position thereof the tape reel 17 reeling up the tape T with a uniform width and a ribbon reel 25 reeling up the ink ribbon R, respectively. The tape T and the ink ribbon R have the same width in size. At a left lower position of the tape reel 17 is made a through hole 55 to be fitted with the head unit 15. Besides, at a position where the tape T and the ink ribbon R overlap each other, there is arranged a platen roller 53 which is driven to rotate by fitting the platen driving shaft 16. On the other hand, there is arranged a ribbon taking-up reel 54 near the ribbon reel 25. The ink ribbon R reeled out from the ribbon reel 25 is reeled up by the ribbon taking-up reel 54 in such a manner as to travel around the through hole 55.

When the tape cartridge C is mounted in the cartridge mounting section 6, the head cover 15*a*, the positioning projection 24 and the reel driving shaft 23 are fit with the through hole 55, the center hole of the tape reel 17, and the center hole of the ribbon taking-up reel 54, respectively. The printing head 7 comes into contact with the platen roller 53 sandwiching the tape T and the ink ribbon R to perform ink-characters printing. In ink-characters printing, not only ink-characters data based on inputted character information but also front-and-rear discriminating information D (see FIG. 5) for discriminating the front-and-rear of the tape T and index information G (see FIG. 22) for indexing a feeding direction of the tape T are printed (a detailed description thereof will be made hereinafter). Then, the tape T printed with ink characters is fed into the printing-tape ejecting port 22. Note that there is provided a traveling path for printing, along which the tape T is fed, from the platen roller 53 to the printing-tape ejecting port 22.

The tape T is composed of the recording tape T1 whose rear face is provided with an adhesive layer and of a releasing tape T2 affixed to the recording tape T1 by the adhesive layer. The recording tape T1 is composed of: in the order from the front side thereof, an image receiving layer with the enhanced fixation of ink thermally transferred from the ink ribbon; a substrate layer made of a polyethylene terephthalate (PET) film, which serves as the main body of the recording tape T1; and the adhesive layer formed of an adhesive in a stacked manner. On the other hand, the releasing tape T2 is used to prevent dust etc. from adhering to the adhesive layer until the recording tape T1 is used as a label, and is made of a quality paper whose front face is subjected to silicone treatment. In this state, the adhesive layer has much less adhesion to the releasing tape T2 than to the substrate layer.

The tape T has a plurality of types varying in tape width, tape color, ink color of ink characters, tape material, etc. Therefore, there are provided a plurality of holes (not shown) for discriminating the types of the tape T on the rear face of the cartridge casing 51. In addition, in the cartridge mounting section 6 are provided a plurality of tape discriminating sensors (micro switches) 171 (see FIG. 6) for detecting the types corresponding to the plurality of holes. In other words, the tape type can be determined by detecting the state of the tape discriminating sensors 171. Note that a description of the present embodiment will be made about three types of tapes: tape widths of 24 mm (tape T1), 18 mm (tape T2), and 12 mm (tape T3) (see FIG. 5).

On the other hand, the rear casing 2*b* includes therein an assembly for braille embossing (the braille embossing section 150), and the top face thereof is opened in a cross shape such that the braille embossing section 150 (more specifically, a tape traveling path 70 (traveling path for embossing), an embossing unit 80, and tape feeding mechanism 60 which will be described below) is exposed. On the right and left sides of a notched opening section 30, there are formed an embossing tape feeding port 31 into which the tape T is manually fed by the user and an embossing-tape ejecting port 32 from which the tape T embossed in braille is ejected, respectively.

The braille embossing section 150 has: the embossing unit 80 in which braille is embossed by three embossing pins 41 (see FIG. 4B); the tape feeding mechanism 60 for feeding into the embossing-tape ejecting port 32 the tape T fed into the embossing tape feeding port 31; and the tape traveling path 70 along which the tape T is fed. In the braille embossing section, the three embossing pins 41 are selectively driven by the embossing unit 80 to form braille B on the tape T being fed along the tape traveling path 70 driven by the tape feeding mechanism 60.

Figure 5:
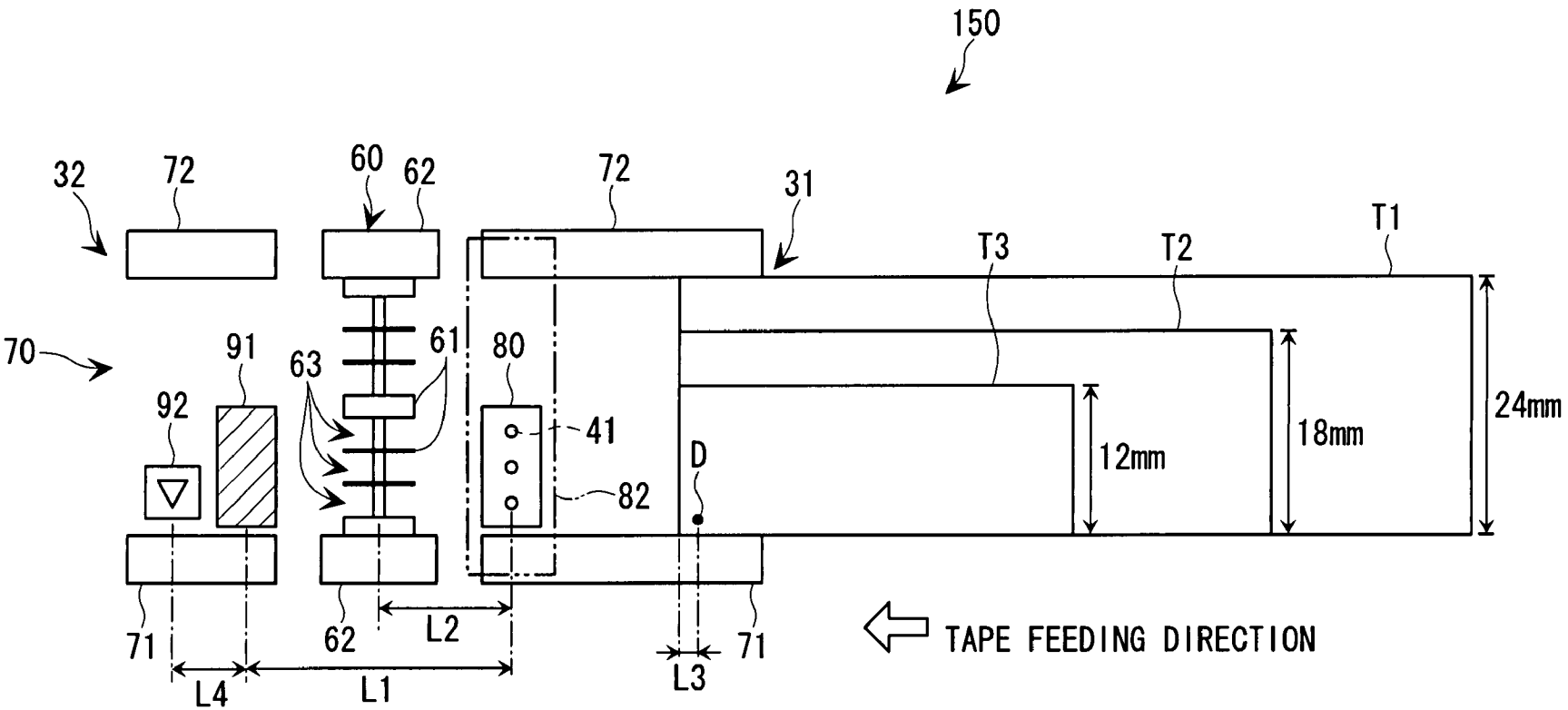
FIG. 5 is an illustration for explaining the delivery of a tape in a braille embossing section.
Figure 6:
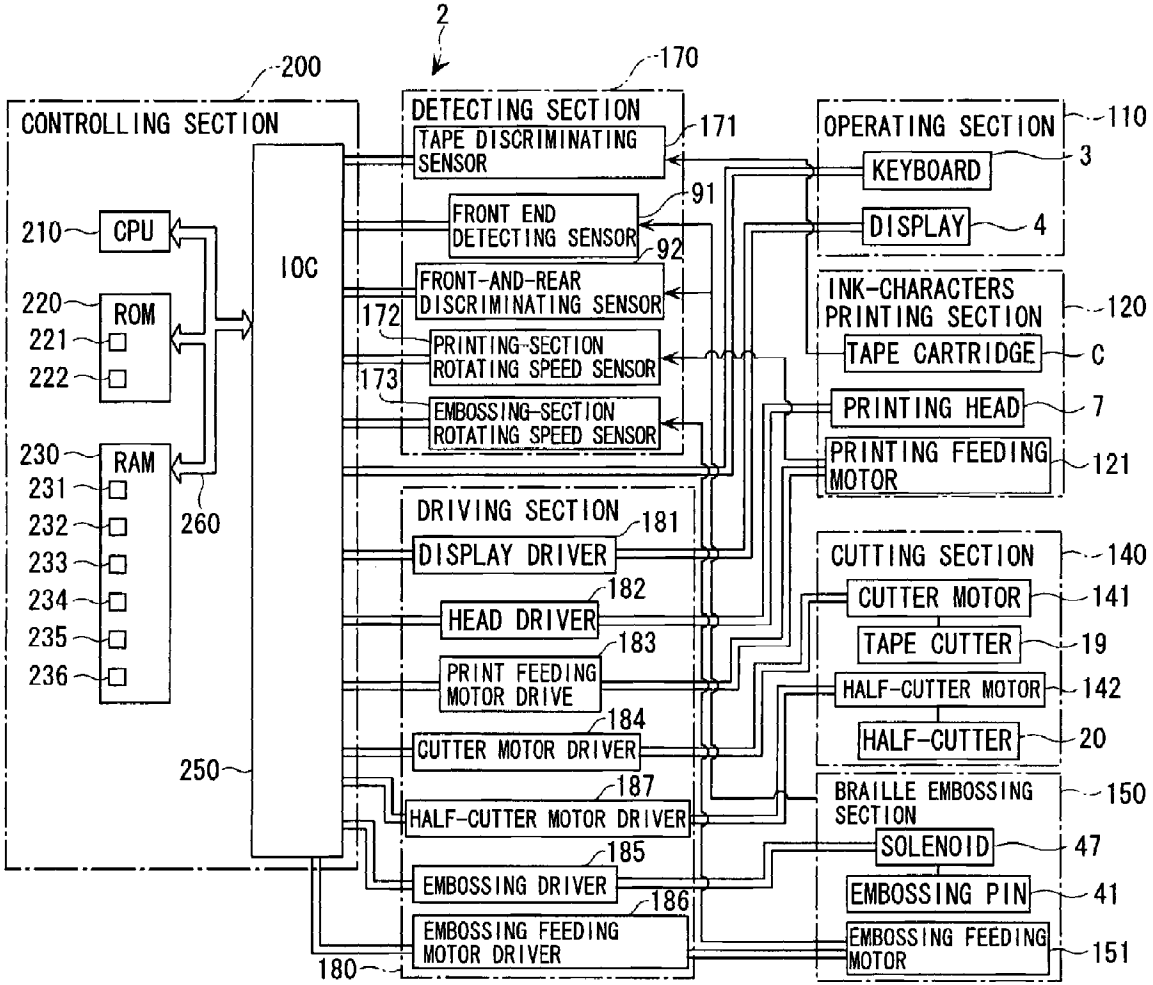
FIG. 6 is a control block diagram of the label forming apparatus.

The tape feeding mechanism 60 is composed of: feeding rollers 61 which can move back and forth; supporting members 62 for supporting the feeding rollers 61 on an apparatus frame 65; and an after-mentioned embossing feeding motor 151 (see FIG. 6). Between the feeding rollers 61 are formed annular grooves 63 (see FIG. 5) free from interference from (arranged in such a manner as to prohibit interfering with) vertical three positions (the positions corresponding to vertically-arranged three embossing points 201 (see FIG. 3A)) in the width direction of the tape traveling path 70, so as to prevent the formed braille B from being crushed.

Figure 4A:
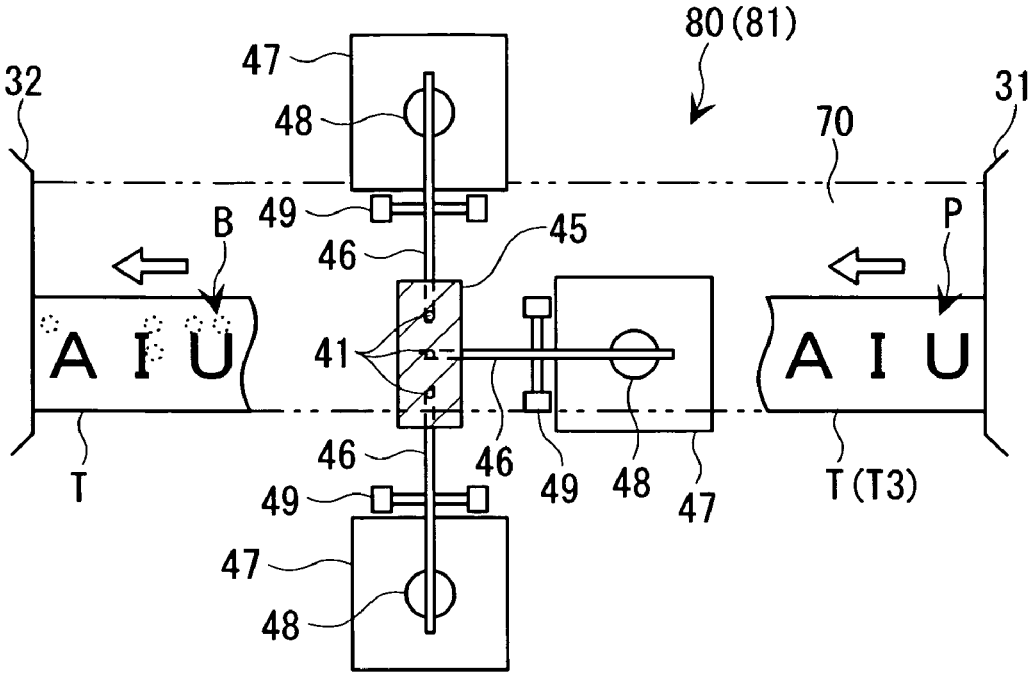
FIGS. 4A and 4B are a plan view and a cross section of an embossing unit.
Figure 4B:
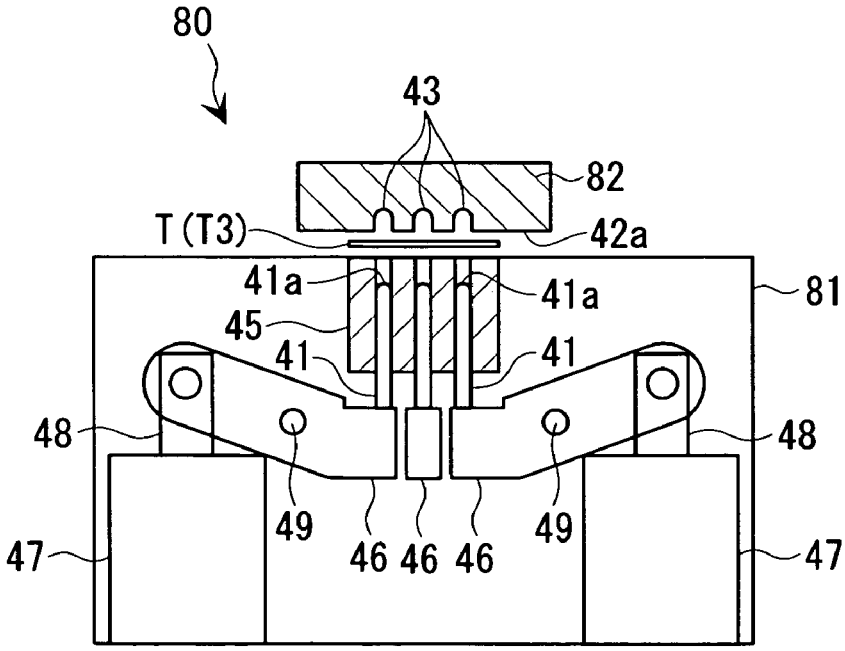

The embossing unit 80 is composed of an embossing head 81 arranged on the rear face of the tape T and having guide blocks 45 which incorporate the three embossing pins 41 and of an embossing receiving member 82 arranged at respective locations above and below the tape T in such a manner as to be opposite to the embossing member 81 (see FIG. 4B). The embossing unit is fixed in position at the near side in the width direction of the tape traveling path 70 (see FIG. 4A). Thus, when braille is embossed on a tape T1 with the maximum width of 24 mm, the near side in the width direction of the tape T1 is to be embossed (see. FIG. 5).

Figure 3A:
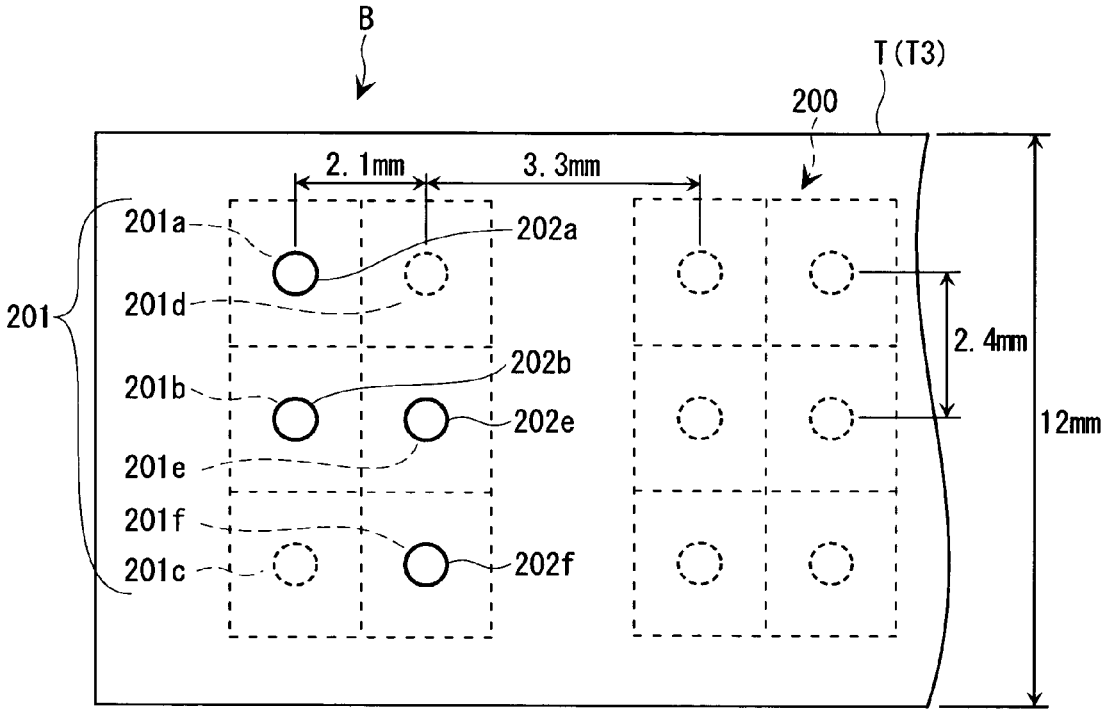
FIGS. 3A and 3B are illustrations of a 6-point (3×2) embossing of braille and a cross section of an embossing convex portion.

A description of braille B (six-point braille B) to be formed on the tape T (T3 with a tape width of 12 mm) will now be made with reference to FIGS. 3A and 3B. FIG. 3A shows the braille B (braille data) indicative of character information "SHI" (representing herein a Japanese hiragana character, meaning that the illustrated Braille is that of hiragana, not of alphabets "SHI"; the same also applies to examples given hereinafter). As shown in the figure, the six-point braille B forms one square 200 constituted of six points (embossing dots) of three dots, which in turn are constituted of three dots in length×two dots in width. The one square 200 represents a character, a voice sound symbol, etc. Note that the braille B has types of the six-point braille indicative of kana-characters, numerals, etc. and an eight-point braille (which forms one square constituted of four dots in length×two dots in width) indicative of Chinese characters. A description will be made about the six-point braille B herein, but the present invention can also be applied to a label forming apparatus forming the eight-point braille as a matter of course.

In the six-point braille B, the one square 200 is divided into six embossing points 201*a* to 201*f* under the arrangement of three dots in length×two dots in width. FIG. 3A shows a state where four embossing points 201*a*, 201*b*, 201*e*, and 201*f* are selectively embossed from among the six embossing points 201*a* to 201*f*, and four embossing convex portions 202*a*, 202*b*, 202*e*, and 202*f* are formed on the tape T. Further, six embossing convex portions 202 are approx. 2.4 mm in vertical pitch and approx. 2.1 mm in horizontal pitch. A pitch from a dot in one square to a dot in another square is approx. 3.3 mm. Furthermore, to emboss the six-point braille B, the minimum required tape width is 12 mm long (tape T3) judging from the size (the length in the tape width direction) of the one square 200.

Figure 3B:
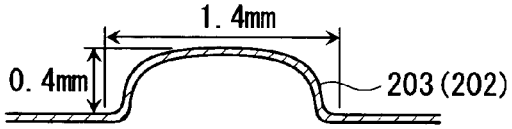
Figure 3B:
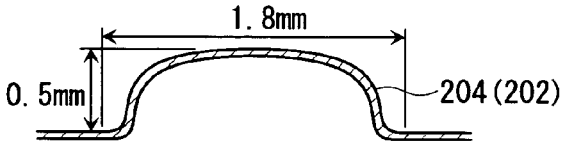

FIG. 3B shows cross sections of the embossing convex portions 202. As shown in the figure, the embossing convex portions 202 are cylindrical with its corner rounded. Note that the embossing convex portions 202 are preferably in such shape (as it feels good to the touch). However, other shapes, such as a hemisphere shape, a cone shape, and a quadrangular pyramid shape may also be accepted.

Further, the label forming apparatus 1 of the embodiment may adopt two other types of mutually replaceable units as the embossing unit 80: one forms small embossing convex portions 203 and the other large embossing convex portions 204. The small embossing convex portions 203 are cylindrical with a diameter of approx. 1.4 mm and a height of approx. 0.4 mm. The large embossing convex portions 204 are cylindrical with a diameter of approx. 1.8 mm and a height of approx. 0.5 mm. These two types of embossing convex portions 203 and 204 may be used according to intended purpose. For example, the small embossing convex portions 203 are intended for those familiar with reading the braille B (congenital blind people), and the large embossing convex portions 204 for beginners (noncongenital blind people).

Next, a description of the configuration of the embossing unit 80 will be made with reference to FIGS. 4A and 4B. FIG. 4A is a plan view of the embossing unit 80 as seen from the top thereof in FIG. 1. FIG. 4B is a cross section of the embossing unit 80. FIG. 4A shows a state where the tape T (with a tape width of 12 mm) printed with ink characters is manually fed into the tape traveling path 70 from the embossing tape feeding port 31 and is fed into the embossing-tape ejecting port 32.

The embossing head 81 is provided with the three embossing pins 41 arranged at intervals of 2.4 mm along the tape width direction (in the vertical direction of the embossing unit in FIG. 4A). The three embossing pins 41 correspond to the vertically-arranged three embossing points 201 out of the six embossing points 201, and are held perpendicular to the tape T by guide blocks 45 for imparting a linear motion with solenoids 47 as a driving source. Head portions 41*a* of the embossing pins 41 are cylindrical with rounded corners such that the embossing convex portions 202 are cylindrical with rounded corners. Note that when the embossing convex portions 202 are hemispherical, conical, or quadrilateral, the head portions 41*a* of the embossing pins 41 are shaped in response thereto.

Further, the embossing pins 41 each have a tail portion thereof connected to one end of arm members 46 in a semi-fixed manner. The arm members 46 have the other end thereof rotatably connected to a front end of plungers 48 of the after-mentioned solenoids 47 and have supporting shafts 49 rotatably supporting an intermediate portion. The plungers 48 and the embossing pins 41 are arranged in parallel to each other such that the plungers 48 of the solenoids 47 move perpendicularly to the tape T. Thus, when the plungers 48 are linearly moved by the solenoids 47, the arm members 46 rotate about the supporting members 49, thereby causing the embossing pins 41 to move linearly perpendicular to the tape T.

Note that there are the three arm members 46, each connected to the three embossing pins 41, which are differently positioned: two of the three arm members positioned at the upper and lower ends extend (vertically) in such a manner as to be separated from each other in the tape width direction, and the other positioned therebetween extends in the feeding direction of the tape T. The three solenoids 47, each connected to the three arm members 46, are arranged in such a manner as to be positioned at each corner of a triangle.

On the other hand, the embossing receiving member 82 has three embossing receiving concave portions 43 formed on a face 42*a* thereof opposite to the three embossing pins 41 for receiving the same. The embossing receiving concave portions 43 are concave cylindrical with rounded corners in accordance with the head shapes of the embossing pins 41. Note that the face 42*a* opposite to the three embossing pins 41 may alternatively be of a flat face constituted of elastic materials such as a rubber rather than the embossing receiving concave portions 43.

The embossing unit 80 thus forms the embossing convex portions 202 on the tape T with the embossing pins 41 and the embossing receiving member 82. In other words, when the solenoids 47 are excited in accordance with braille data generated based on inputted character information and the plungers 48 are sucked, the embossing pins 41 are caused to move perpendicularly to the tape T after being guided by the guide blocks 45. The embossing pins are then bumped into the corresponding embossing receiving concave portions 43 across the tape T, thus forming the embossing convex portions 202 on the tape T.

Next, a description of the feeding of the tape T in the braille embossing section 150 will be made with reference to FIG. 5. As described above, the braille embossing section 150 is composed not only of: the embossing unit 80 for forming the embossing convex portions 202 on the tape T with the embossing pins 41; the tape traveling path 70 along which the tape T is fed; the tape feeding mechanism 60 for feeding the tape T along the tape traveling path 70; but also of guide members 71 and 72 for guiding the feeding of the tape T; a transmission front end detecting sensor 91 for detecting the front end of the tape T; and a reflective front-and-rear discriminating sensor 92 (detecting sensor) for detecting the front-and-rear discriminating information D for discriminating the front-and-rear of the tape T.

In the embossing tape feeding port 31, the three types of tapes in a decreasing order of the tape width, i.e., tape T1 (with a width of 24 mm), tape T2 (with a width of 18 mm), and tape T3 (with a width of 12 mm) can be fed. The tape T1 with the maximum tape width is guided by the upper and lower guide members 71 and 72, whereas the tapes T2 and T3, each with a smaller tape width as compared with the tape T1, are guided only by the lower guide members 71. For example, when the tape T3 with the minimum tape width is used, the user manually feeds it along the front lower guide member 71 until the front end thereof reaches (namely, it is positioned in such a manner as to be fed into) the tape feeding mechanism 60 (feeding rollers 61). When the user depresses the feeding start key on the keyboard 3, the tape feeding mechanism 60 causes the feed of the tape T3 to start.

At this time, when a front margin from the front end of the tape to an embossing start position is set shorter than L1, the length extending between the embossing unit 80 (embossing pins 41) and the front end detecting sensor 91 (note, however, that the front margin should be set longer than L2, the length extending between the embossing unit 80 and the feeding rollers 61 in view of the positional relationship involved), the feeding rollers 61 are caused to backlash to feed back the tape T. When the tape T is fed back to an adequate position by a counter rotation, embossing and feeding thereof to a normal direction begin. Note that braille embossing with the embossing unit 80 is performed in accordance with a layout selected by the user. When the user selects a layout where the braille embossing region Eb agrees in position with the embossing unit 80 (a position adjacent to the lower end (near side) in the width direction of the tape traveling path 70) (when the user selects a layout where the braille embossing region Eb is defined at a position adjacent to the lower end in the width direction of the tape traveling path 70, i.e., the basic layout structure), braille data is embossed in a forward direction (normal embossing). Further, when the user selects a layout where the braille embossing region Eb disagrees in position with the embossing unit 80 (a position adjacent to the lower end (far side) in the width direction of the tape traveling path 70) (when the user selects a layout where the braille embossing region Eb is defined at a position adjacent to the upper end in the width direction of the tape traveling path 70), braille data is embossed in a state of being inverted. A detailed description of the above will be made hereinafter. When the embossing is completed, the tape feeding mechanism 60 causes the tape to be fed at a given distance. Then, the tape T is ejected from the embossing-tape ejecting port 32.

Note that the user may manually start operating the embossing unit 80 by depressing the embossing start key on the keyboard 3, instead of allowing the front end detecting sensor 91 to detect the front end of the tape.

Next, a description of the control structure of the label forming apparatus 1 will be made with reference to FIG. 6. The label forming apparatus 1 is composed of an operating section 110, an ink-characters printing section 120, a cutting section 140, a braille embossing section 150, a detecting section 170, a driving section 180, and a controlling section 200. The operating section 110 has the keyboard 3 and the display 4, and serves as a user interface for allowing the user to input character information or display various information. The ink-characters printing section 120 has the tape cartridge C, the printing head 7, and the printing feeding motor 121, and prints on the tape T ink-characters data based on character information while feeding the tape T and the ink ribbon R. The cutting section 140 has the tape cutter 19, the half-cutter 20, the cutter motor 141 for driving thereof, and the half-cutter motor 142 and cuts off the tape T in a half-cutting or full-cutting manner. The braille embossing section 150 has the solenoids 47, the embossing pins 41, and the embossing feeding motor 151, and embosses on the tape T braille data based on character information while feeding the same. The detecting section 170 has: the tape discriminating sensors 171 for discriminating the type of the tape T (tape cartridge C); the front end detecting sensor 91 for detecting the front end of the tape T in the braille embossing section 150; the front-and-rear discriminating sensor 92 for discriminating front-and-rear discriminating information D printed on the tape T in the braille embossing section 150; a printing-section rotating speed sensor 172 for detecting the rotating speed of the printing feeding motor 121; and an embossing-section rotating speed sensor 173 for detecting the rotating speed of the embossing feeding motor 151. With such sensors, the detecting section performs various detections. The driving section 180 has a display driver 181, a head driver 182, a printing feeding motor driver 183, a cutter motor driver 184, a half-cutter motor driver 187, an embossing driver 185, and an embossing feeding motor driver 186. With such drivers, the driving section drives each of the sections. The controlling section 190 is connected to each of the sections, and controls the label forming apparatus 1 as a whole.

The controlling section 190 has a CPU 210, a ROM 220, a RAM 230, and an input/output controller (hereinafter referred to as IOC) 250, all of which are connected to one another through an internal bus 260. The ROM has a control program block 221 and a control data block 222. The control program block stores therein control programs for controlling various processes including ink-characters printing or braille embossing with the CPU 210. The control data block stores therein data for printing in ink front-and-rear discriminating information D and index information G, control data for controlling the embossing of braille data, etc., in addition to character font data for ink-characters printing and braille font data for braille embossing. Note that the character font data may be stored in a CG-ROM (character generation ROM), rather than in the ROM 220.

Figure 9A:
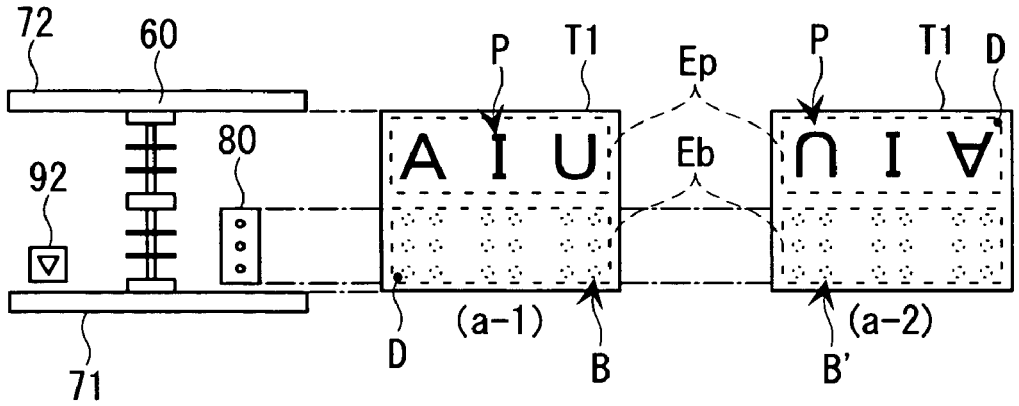
FIGS. 9A to 9C are illustrations for supplementally explaining the flow chart of FIG. 7.
Figure 9B:
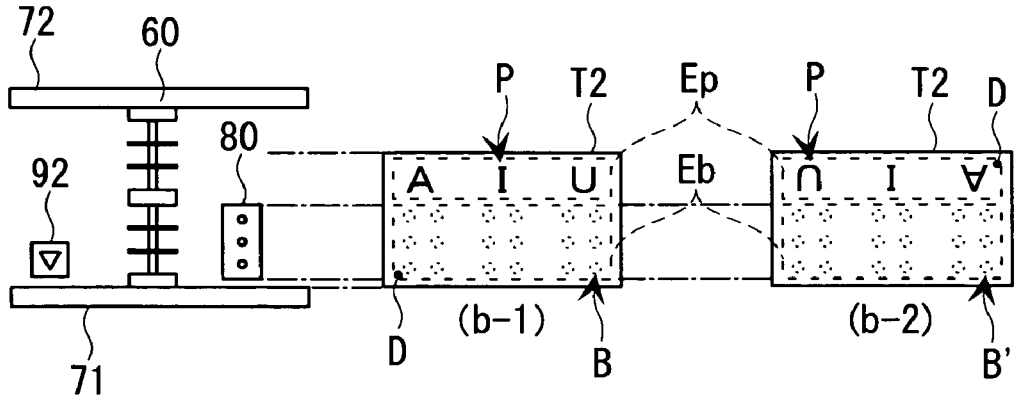
Figure 9C:
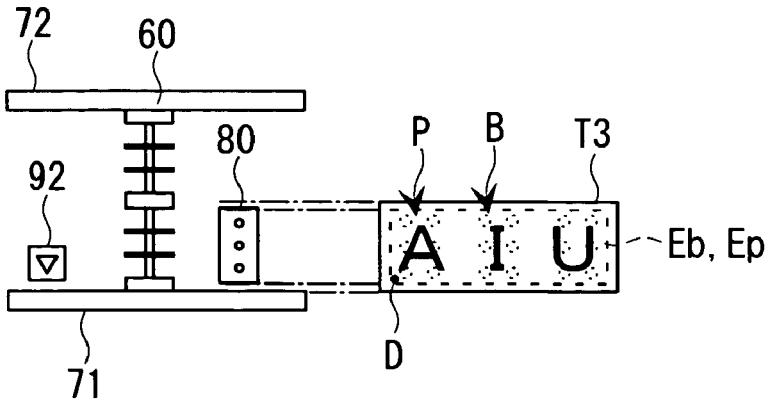

The RAM 230 has: various work area blocks 231 to be used as a flag etc.; an ink-characters printing data block 232 for storing generated ink-characters printing data; a braille embossing data block 233 for storing generated braille embossing data; a display data block 234 for storing display data to be displayed on the display 4; a layout block 235 for storing the layout of defined ink-characters printing region Ep and braille embossing region Eb; an inverted braille data block 236 for storing inverted braille data B' (data in which braille data is developed from the end thereof, see FIGS. 9A to 9C) to be used in a case where braille data is embossed in a state of being inverted in accordance with the selected layout. In other words, the RAM is used as a work area for control processes. Further, the RAM 230 is always battery-protected for holding stored data in case of power-off.

The IOC 250 has incorporated therein a logic circuit for complementing functions of the CPU 210 and handling interface signals with various peripheral circuits through a gate array and a custom LSI. Thereby, the IOC 250 receives into the internal bus 260 input data or control data through the keyboard 3 either with or without processing the same. In addition, the IOC outputs to the driving section 180 data or control signals outputted to the internal bus 260 from the CPU 210 either with or without processing the same while interlocking the CPU 210.

With the above configuration, the CPU 210 inputs various signals/data from each section of the label forming apparatus 1 through the IOC 250 in accordance with the control programs of the ROM 220. Further, the CPU processes various data of the RAM 230 based on the inputted various signals/data, and outputs the various signals/data to each section of the label forming apparatus 1 through the IOC 250, thereby controlling the processes of ink-characters printing and braille embossing.

For example, when the user inputs character information through the keyboard 3, the CPU 210 generates ink-characters printing data based on the character information and temporarily stores the same in the ink-characters printing data block 232. Besides, the CPU generates braille embossing data based on the character information and temporarily stores the same in the braille embossing data block 233. Further, when the user commands ink-characters printing and braille embossing (selects to start the first process mode) through the keyboard 3, the CPU brings the printing feeding motor 121 and the printing head 7 into action in response to a determination result by the printing-section rotating speed sensor 172, thereby performing ink-characters printing based on the ink-characters data of the ink-characters printing data block 232. At this time, besides the ink-characters data, front-and-rear discriminating information D and index information G are printed (based on the data previously stored in the control data block 222) by the CPU. Thereafter, the CPU causes the tape to be fed at a given distance based on the ink-characters printing data (including rear margin data in a case where a rear margin can be defined in inputting the character information), thereby cutting off the tape T with the tape cutter 19 and ejecting the same from the printing-tape ejecting port 22.

Subsequently (in a state where no reset operation or power-off operation is made), when the user manually feeds the tape T cut into a strip into the embossing tape feeding port 31, the CPU brings the embossing unit 80 and the tape feeding mechanism 60 into action as in the above-described cases, thereby performing braille embossing based on the inverted braille data B' (see FIGS. 9A to 9C) of the braille embossing data block 233 or the inverted braille data block 236. When the embossing is completed, the CPU brings the embossing feeding motor 151 into action, thereby feeding the tape at a given distance based on the braille embossing data (including rear margin data in a case where a rear margin can be defined in inputting the character information). The tape T is then ejected from the embossing-tape ejecting port 32.

Figure 7:
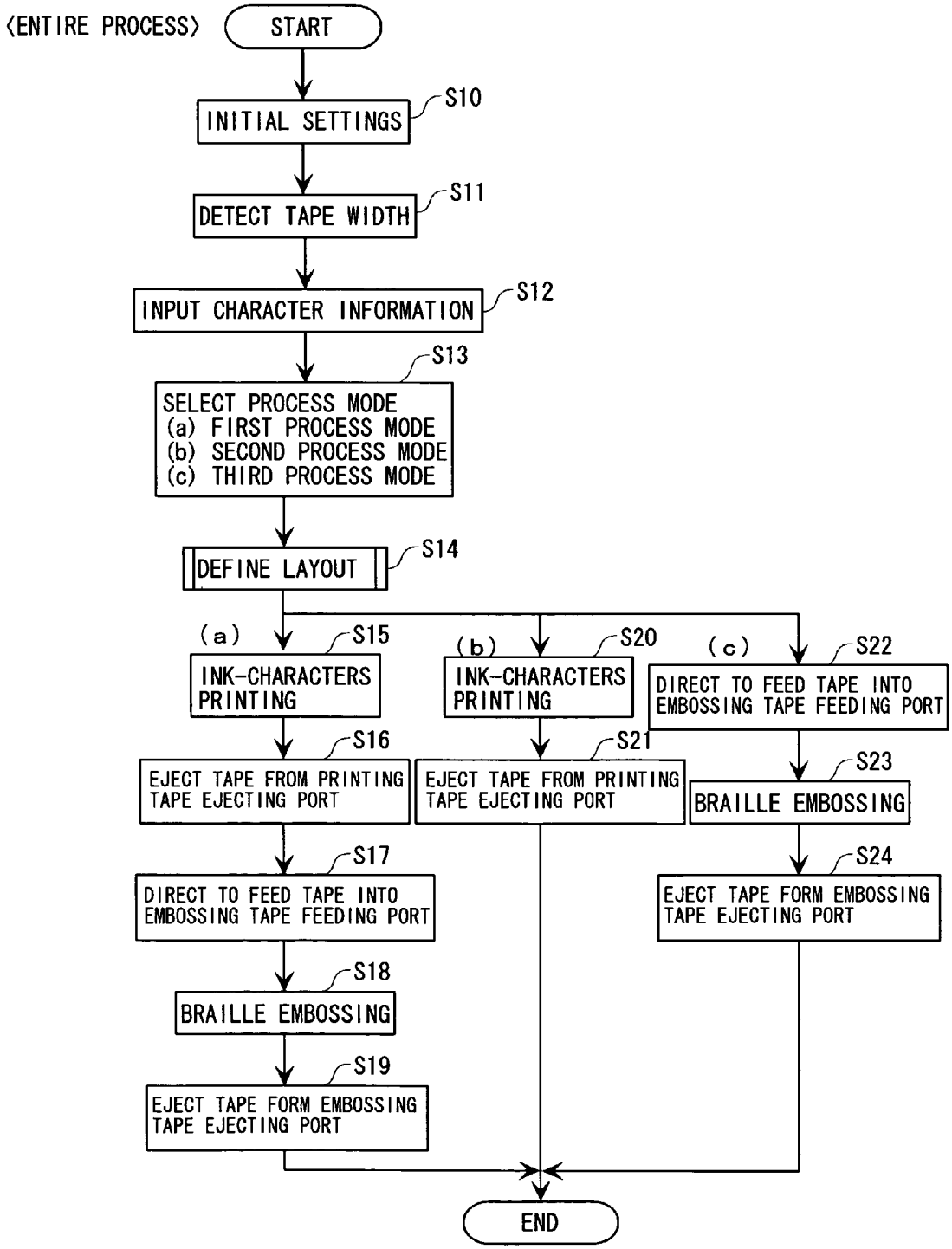
FIG. 7 is a flow chart showing an entire process of the label forming apparatus.

Next, a description of the entire process of the label forming apparatus 1 will be made with reference to FIGS. 7, 8A to 8C, and 9A to 9C. As shown in FIG. 7, in the label forming apparatus, when the user depresses a power key (power-on) to start a process, first, each of the saved control flags is caused to be restored to the initial settings so as to return to the previous power-off state (S10), and the tape discriminating sensors 171 (see FIG. 6) detect the type of tapes (i.e., tape width) (S11). Note that, in the present embodiment, the tape discriminating sensors are to detect the width of tapes (tape T1 with a width of 24 mm, tape T2 with a width of 18 mm, and tape T3 with a width of 12 mm, see FIGS. 9A to 9C) as the types thereof.

Subsequently, when the user inputs character information (in the form of data) through external devices such as the keyboard 3 or a personal computer (S12), a process mode out of the first, second, and third process modes is selected (S13), and a layout is defined (S14). In the definition of the layout (S14), the ink-characters printing region Ep and the braille embossing region Eb on the tape T are defined based on the results of detecting the tape width (S11) and selecting the process mode (S13).

For example, let it be assumed that the first process mode is selected. As shown in FIGS. 9A to 9C, when the tape discriminating sensors detect that the tape width is 24 mm long (tape T1) (see FIG. 9A), the layout of the tape is selected from either of: the ink-characters printing region Ep at the upper side and the braille embossing region Eb at the lower side (a-1), or the ink-characters printing region Ep at the lower side and the braille embossing region Eb at the upper side (a-2). Note that ups-and-downs of the tape T herein is based on the state where front-and-rear discriminating information D is directed to the feeding direction of the tape (leftward orientation), and the front face of the tape serves as the recording tape T1. Similarly, when the tape discriminating sensors detect that the tape width is 18 mm long (tape T2) (see FIG. 9B), the layout of the tape is selected from either of: the ink-characters printing region Ep at the upper side and the braille embossing region Eb at the lower side (b-1), or the ink-characters printing region Ep at the lower side and the braille embossing region Eb at the upper side (b-2). In this case, however, the ink-characters printing region Ep is made smaller in the tape width direction. Further, when the tape discriminating sensors detect that the tape width is 12 mm long (tape T3) (see FIG. 9C), the layout of the tape lies only in a state where the ink-characters printing region Ep and the braille embossing region Eb overlap each other. Thus, when the tape discriminating sensors detect that the tape width is 12 mm long and the first process mode is selected, the user is not allowed to define the layout.

Note that, in the definition of the layout (S14), when the user selects the second process mode (ink-characters printing only) in selecting the process mode (S13), a character size or the number of lines in ink-characters printing is defined as in the case of layout definition performed by general word processors etc. Further, when the user selects the third process mode (braille embossing only) in selecting the process mode (S13), he/she is required to select the layout: the braille embossing region Eb is defined at either the upper side or the lower side of the tape in the case of tape T1 with a width of 24 mm (see FIG. 9A), and the braille embossing region Eb is defined at either the upper side or the lower side of the tape in the case of the tape T2 with a width of 18 mm. In other words, since the one square 200 of the braille B is fixed in size (the length in the tape width direction), the braille embossing region Eb is defined at a position adjacent to one end (either the upper side or the lower side of the tape) in the tape width direction (see FIG. 9B). Further, a width of 12 mm of the tape T3 is the minimum length in which the one square 200 of the braille (the length in the tape width direction) can be embossed (see FIG. 3A). Thus, when the tape discriminating sensors detect that the tape width is 12 mm long and the third process mode is selected, the user is not allowed to define the layout.

Following the definition of the layout (S14), ink-characters printing and/or braille embossing are/is automatically started. In other words, when the user selects the first process mode (S13: (a)), the ink-characters printing section 120 starts ink-characters printing after the definition (selection) of the layout (S15). After ink-characters printing, the tape T is ejected from the printing-tape ejecting port 22 (S16), and directions to feed the tape into the embossing tape feeding port 31 are displayed on the display 4 (S17). Note that the display for the feeding may be made by an indicator or an LED. When the user feeds the tape T into the embossing tape feeding port 31 in response to the feeding direction thereof, the braille embossing section 150 performs braille embossing (S18). After the embossing in braille, the tape T is ejected from the embossing-tape ejecting port 32 (S19), and the process is completed.

Figure 8A:
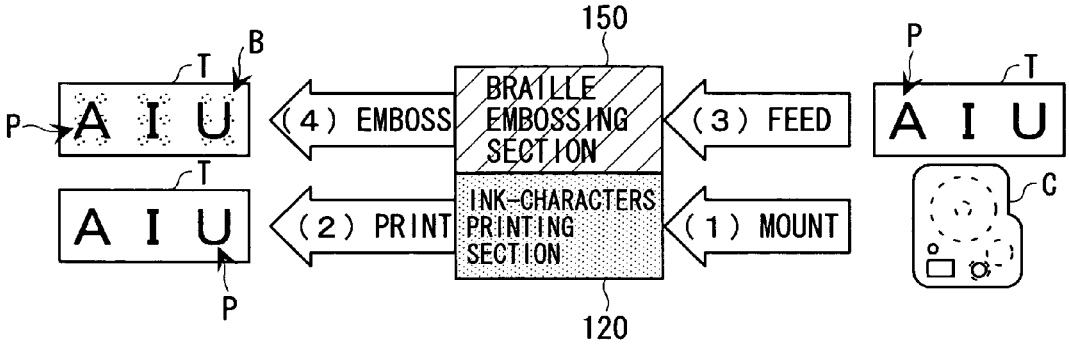
FIGS. 8A to 8C are illustrations for supplementally explaining the flow chart of FIG. 7.

More specifically, in the first process mode, as shown in FIG. 8A, the tape T reeled out from the mounted tape cartridge C is fed into the ink-characters printing section 120, and ink characters P are printed thereon. The tape T printed with the ink characters (which has been cut off) is manually fed into the braille embossing section 150, and braille B is embossed thereon. Further, in this case, the braille embossing section 150 (i.e. the front-and-rear discriminating sensor) detects the front-and-rear discriminating information D, and determines the braille embossing direction in accordance with the detection result and the definition of the layout. In a case where the user feeds the tape from the wrong side, the braille embossing section does not perform braille embossing (a detailed description thereof will be made hereinafter).

Figure 8B:
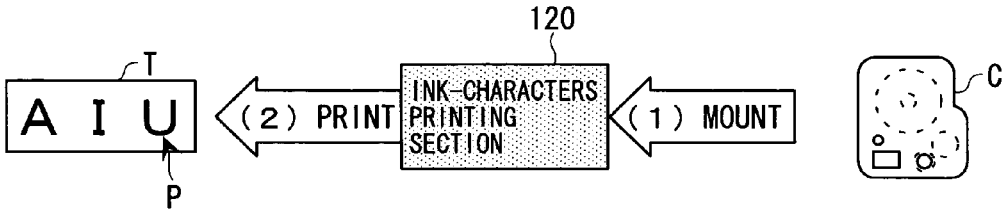
Figure 8C:
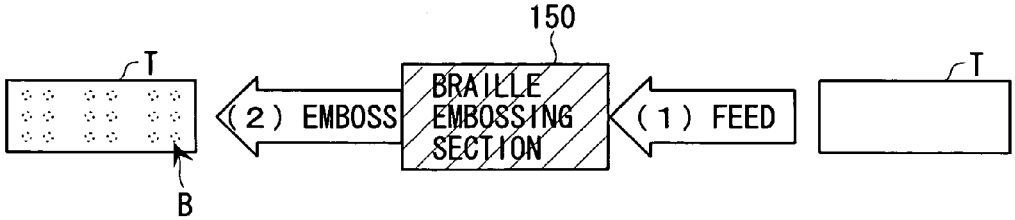

Further, when the user selects the second process mode (S13: (b)), after being printed with ink characters by the ink-characters printing section 120 (S20), the tape T is ejected from the printing-tape ejecting port 22 (S21), and the process is completed. In other words, in the second process mode, as shown in FIG. 8B, the tape T reeled out from the mounted tape cartridge C is fed into the ink-characters printing section 120, and the ink characters P are printed thereon. Note that, when the user selects the second process mode, printing of the front-and-rear discriminating information D can be omitted.

Further, when the user selects the third process mode (S13: (c)), directions to feed the tape into the embossing tape feeding port 31 are displayed on the display 4 (S22), and the user feeds the tape thereinto. After embossing in braille (S23), the tape T is ejected from the embossing-tape ejecting port 32 (S24), and the process is completed. In other words, in the third process mode, as shown in FIG. 8C, a strip tape T (cut into a given length) is manually fed into the braille embossing section 150 and embossed in the braille B. Further, as in the case of the first process mode, the braille embossing section 150 (i.e. the front-and-rear discriminating sensor) detects the front-and-rear discriminating information D, and determines the braille embossing direction in accordance with the detection result and the definition of the layout. In a case where the user feeds the tape from the wrong side, the braille embossing section does not perform braille embossing. Note that, when the user selects the third process mode, detection of the front-and-rear discriminating information D can be omitted. Further, the user may select whether or not the front-and-rear discriminating information D should be detected in the third process mode.

In the above description, the user selects from among the three process modes. It is possible to add another mode in which a strip tape is fed into the ink-characters printing section 120. In this manner, the tape is to be printed with ink characters after braille embossing. Further, as opposed to the above, the apparatus may be arranged such that the tape cartridge C is mounted in an upstream of the braille embossing section 150, and an elongated tape reeled out therefrom is embossed in braille. Further, it is possible to perform ink-characters printing and braille embossing based on different character information, rather than the same character information.

Next, a description of a braille embossing process of the label forming apparatus 1 will be made with reference to FIGS. 10 and 11A to 11D. The following is a case where the tape discriminating sensors detect that a tape width is 24 mm long (tape T1) (see S11 of FIG. 7), and the user selects the first process mode (see S13 of FIG. 7).

Figure 10:
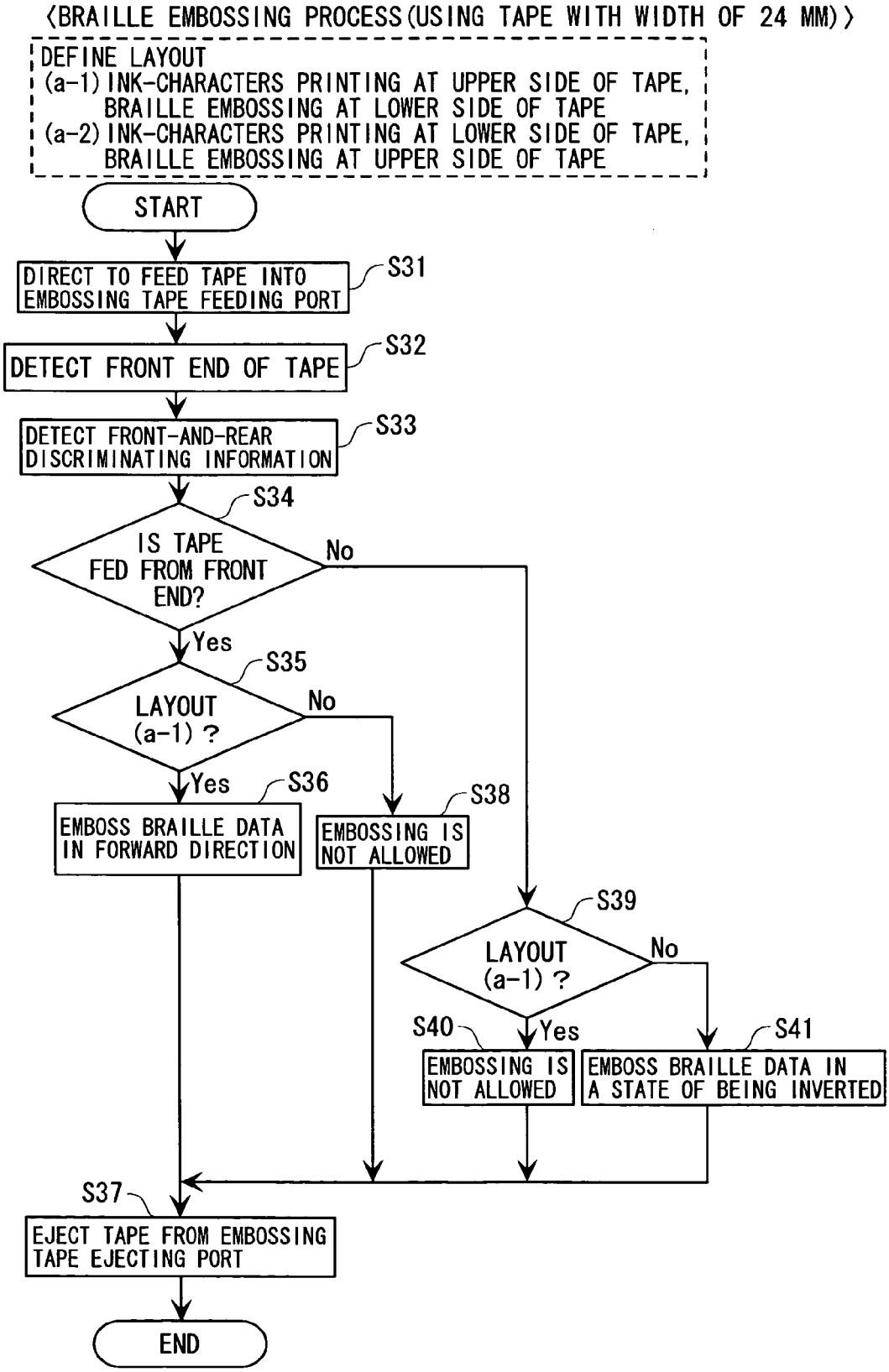
FIG. 10 is a flow chart showing a braille embossing process of the label forming apparatus.

As shown in FIG. 10, when the directions to feed the tape into the embossing tape feeding port 31 are displayed on the display (see S31 equivalent to S17 and S22 of FIG. 7), and then the user feeds the tape T printed with ink characters thereinto, the front end detecting sensor 91 (see FIG. 5) detects the front end of the tape T (S32). The embossing-section rotating speed sensor 173 (see FIG. 6) detects the rotating speed of the feeding rollers 61 in response to the detection of the front end, thereby determining the tape length to be fed.

In response to the detection of the front end of the tape T (S32), the front-and-rear discriminating sensor 92 detects the front-and-rear discriminating information D (S33). The detection of the front-and-rear discriminating information D is accompanied by a tape feeding (tape feeding in a forward direction) at a given distance enough to detect the same. For example, the tape is fed at a given distance consisting of L3 (see FIG. 5), the length extending between the front end of the tape and the front-and-rear discriminating information D in a tape feeding direction and of L4 (see FIG. 5), the length extending between the front end detecting sensor 91 and the front-and-rear discriminating sensor 92, and a given distance with due consideration for a possible detection error. More specifically, when the front-and-rear discriminating information D is detected while the tape is being fed at a given distance, it is found that the tape T is fed from the front end thereof (S34: Yes). While, when the front-and-rear discriminating information D is not detected even after the tape has been fed at a given distance, it is found that the tape T is fed from the rear end thereof (S34: No). In a case where the front margin from the front end of the tape to the embossing start position is set shorter than L1, the length extending between the embossing unit 80 (embossing pins 41) and the front end detecting sensor 91, the feeding rollers 61 are caused to backlash after the front-and-rear discriminating information D is detected.

Then, the label forming apparatus determines the embossing start position (embossing timing) based on the detection result of the embossing-section rotating speed sensor 173 and generated braille data (containing therein data of the front margin from the front end of the tape to the embossing start position as well), and starts embossing thereat. In a case where the user selects a layout in which the ink-characters printing region Ep and the braille embossing region Eb are respectively defined at the upper and the lower sides of the tape (a-1)(S35: Yes), the apparatus embosses (performs normal embossing) the braille data in a forward direction (S36). In other words, in the present embodiment, since the embossing unit 80 is arranged at a position adjacent to the lower end of the tape traveling path 70 in the width direction thereof (see FIGS. 11A to 11D), the basic layout structure shows a state where the braille embossing region Eb is defined at the lower side of the tape. When the tape T is fed from the front end thereof under this basic layout structure, the apparatus performs the normal embossing. After the braille data is embossed, the apparatus causes the tape to be fed at a given distance, thereby ejecting the embossed tape T from the embossing-tape ejecting port 32 (S37).

On the other hand, when the user selects a layout in which the ink-characters printing region Ep and the braille embossing region Eb are respectively defined at the lower and the upper sides of the tape (a-2) (S35: No), the layout will show a state opposite to the basic layout structure. Accordingly, when the tape T is fed from the front end thereof, the apparatus will show that the feeding direction is wrong, and will not allow the tape from being embossed in braille (S38). In other words, the user is required to change the feeding direction of the tape T in accordance with the definition of the layout (he/she is required to feed the tape either from the front end thereof under the layout a-1 or from the rear end thereof under the layout a-2). However, when it is found that the feeding direction is wrong as a result of the detection of the front-and-rear discriminating information D, the braille data is prevented from being embossed.

Further, when the tape T is fed from the rear end thereof (S34: No), and the ink-characters printing region Ep and the braille embossing region Eb are respectively defined at the upper and the lower sides of the tape under the layout (a-1)(S39: Yes), the feeding direction of the tape T is wrong for the defined layout. Accordingly, in this case also, the braille data is prevented from being embossed (S40).

Further, when the tape T is fed from the rear end thereof (S34: No), and the ink-characters printing region Ep and the braille embossing region Eb are respectively defined at the lower and the upper sides of the tape under the layout (a-2)(S39: No), the feeding direction of the tape T for the defined layout is right. Accordingly, the braille data is embossed in a state of being inverted (S41).

Figure 11A:
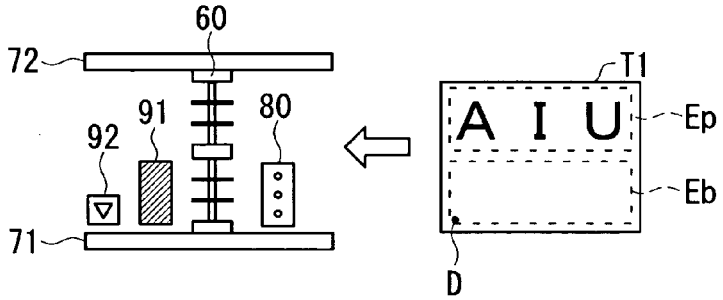
FIGS. 11A to 11D are illustrations for supplementally explaining the flow chart of FIG. 10.

Under the basic layout structure (a-1) as shown in FIG. 11A, the user feeds the tape T (T1) with the front-and-rear discriminating information D provided at the bottom left corner thereof along the upper and lower guide members 71 and 72. After the front end detecting sensor 91 detects the front end of the tape, when the front-and-rear discriminating sensor 92 detects the front-and-rear discriminating information D while the tape is being fed at a given distance, it is found that the tape T is rightly fed from the front end thereof. Accordingly, the apparatus reads out the braille data stored in the braille embossing data block 233 (see FIG. 6), and embosses the same from the beginning thereof.

Note that the braille data is constituted of a data segment generated for embossing the braille B based on inputted information (representing herein hiragana characters "A," "I," and "U"), front margin data, and rear margin data. Accordingly, "to emboss the braille data from the beginning thereof (i.e., to emboss the braille data in a forward direction)" means to emboss the braille data in the following order: the front margin data, data of the three vertical embossing points 201*a*, 201*b*, and 201*c* (see FIG. 3A) in the left column of the first character (representing herein the hiragana character "A"), data of the three vertical embossing points 201*d*, 201*e*, and 201*f* in the right column of the first character (also representing herein the hiragana character "A"), data of the three vertical embossing points 201*a*, 201*b*, and 201*c* in the left column of the second character (representing herein the hiragana character "I"), and the rear margin data.

Figure 11B:
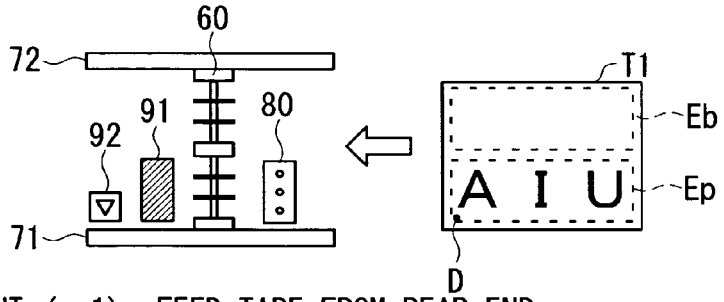
Figure 11C:
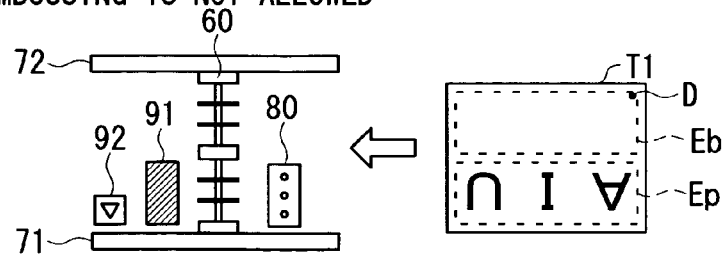
Figure 11D:
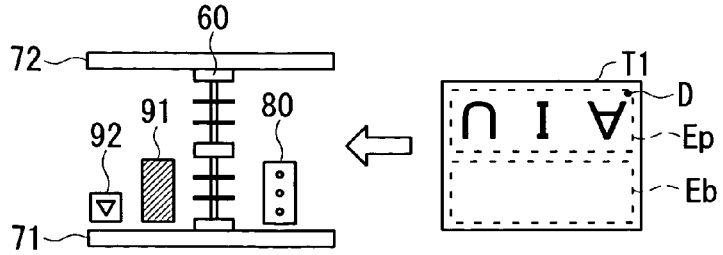

Further, under the state opposite to the basic layout structure (a-2) as shown in FIG. 11B, the user is required to feed the tape T from the rear end thereof (since the embossing unit 80 is not allowed to emboss) (see FIG. 11D). After the front end detecting sensor 91 detects the front end of the tape, when the front-and-rear discriminating sensor 92 detects the front-and-rear discriminating information D while the tape is being fed at a given distance, it is found that the tape T is wrongly fed from the front end thereof by the user, thereby preventing the braille from being embossed.

Further, under the basic layout structure (a-1) as shown in FIG. 11C, the user is required to feed the tape T from the front end thereof (see FIG. 11A). After the front end detecting sensor 91 detects the front end of the tape, when the front-and-rear discriminating sensor 92 does not detect the front-and-rear discriminating information D while the tape is being fed at a given distance, it is found that the tape T is wrongly fed from the rear end thereof by the user, thereby preventing the braille from being embossed in this case also.

Further, under the state opposite to the basic layout structure (a-2) as shown in FIG. 11D, the user is required to feed the tape T from the rear end thereof as described above. However, after the front end detecting sensor 91 detects the front end of the tape, when the front-and-rear discriminating sensor 92 does not detect the front-and-rear discriminating information D while the tape is being fed at a given distance, it is found that the tape T is rightly fed from the rear end thereof. Accordingly, the apparatus reads out the inverted braille data B' (see FIG. 9A) stored in the inverted braille data block 235 (see FIG. 6), and embosses the same from the end thereof. Note that "to emboss the inverted braille data from the end thereof (i.e., to emboss the braille data in a state of being inverted)" means to emboss the inverted braille data in the following order: rear margin data, data in which the three vertical embossing points 201*d*, 201*e*, and 201*f* (see FIG. 3A) in the right column of the last character (representing herein the hiragana character "U") are upside down, data in which the three vertical embossing points 201*d*, 201*e*, and 201*f* in the left column of the last character (also representing herein the hiragana character "U") are upside down, data in which the three vertical embossing points 201*d*, 201*e*, and 201*f* in the right column of the second last character (representing herein hiragana character "I") are upside down, and the front margin data.

As described above, the braille embossing section 150 determines the braille embossing direction in accordance with the definition of a layout. Accordingly, even if the embossing unit 80 is fixed in position in the tape width direction, the user can define a layout as he/she wishes. Further, in the apparatus, the feeding direction of the tape T is detected based on the front-and-rear discriminating information D printed thereon, and it is thus found whether or not the braille should be embossed. Accordingly, even if the user feeds the tape from the wrong side, the tape is prevented from being embossed, thereby eliminating useless use of the tape T.

Since the front-and-rear discriminating information D is printed near the front end of the tape T in the feeding direction thereof, the user is allowed to promptly detect the front-and-rear of the tape after the front end of the tape is detected and the tape is fed at a given distance. Further, since the front-and-rear discriminating information D (i.e. a mark) is placed near the end in the tape width direction, the visibility of printed ink-characters data is not deteriorated.

Further, the front-and-rear discriminating information D indicates the front-and-rear of the tape, thereby allowing the user to feed the tape T rightly in accordance with the layout as he/she has defined. Further, with the front-and-rear discriminating information D, the user is prevented from wrongly discriminating the front-and-rear (ups-and-downs) of the tape when affixing a formed label. Note that the front-and-rear discriminating information D may be printed near the rear or front end in the width direction of the tape T.

The above is the description of the case where the tape width is detected to be 24 mm long (tape T1) (see S11 of FIG. 7), and the first process mode is selected by the user (see S13 of FIG. 7). In the case of a tape with a width of 18 mm (tape T2) also, braille is prevented from being embossed in cases where the braille embossing region Eb is defined under the basic layout structure (b-1) and the tape is fed from the rear end thereof, and the braille embossing region Eb is defined under the one opposite to the basic layout structure (b-2) and the tape T is rightly fed from the front end thereof (see FIG. 9B). Further, similarly, in the case of a tape with a width of 12 mm (tape T3), the braille embossing region Eb is necessarily defined under the basic layout structure. Accordingly, if the tape is fed from the rear end thereof, braille is prevented from being embossed (see FIG. 9C). Note that when the user selects the third process mode (braille embossing only), embossing controls will be made in a manner identical to the cases above.

Further, when the directions to feed the tape into the embossing tape feeding port 31 are displayed on the display 4 (see S31 of FIG. 10), the feeding direction of the tape T may appropriately be displayed. In other words, when the tape is defined under the basic layout structure, a message, "FEED TAPE FROM THE FRONT END" may be displayed. While, when the tape is defined under the one opposite to the basic layout structure, a message, "FEED TAPE FROM THE REAR END" may be displayed. With this configuration, the user has only to follow the displayed the message to discriminate the feeding direction of the tape T without bothering to take the defined layout into consideration, which at the same time makes it possible to eliminate waste of time resulting from the wrong feeding of the tape T.

Next, a description of another example about the front-and-rear discriminating information D printed by the ink-characters printing section 120 will be made with reference to FIGS. 12A to 12F. In other words, front-and-rear discriminating information D may take a form other than the one with a dot "•" printed at the front end of the bottom left corner as shown in FIG. 12A.

Figure 12A:
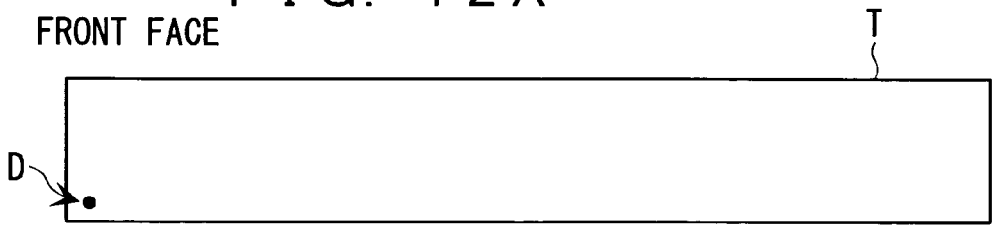
FIGS. 12A to 12F are drawings showing an example of front-and-rear discriminating information.
Figure 12B:
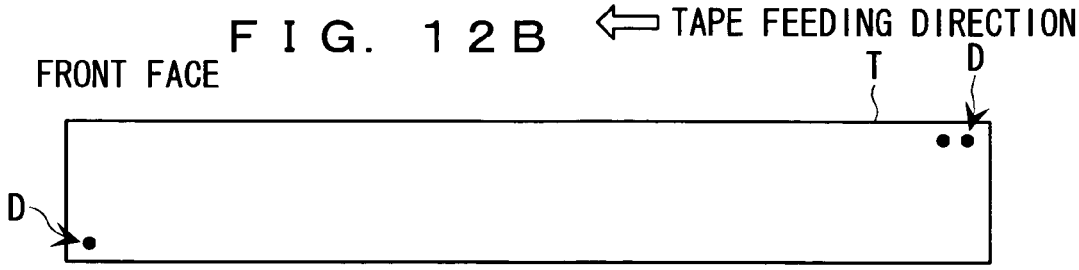

For example, FIG. 12B shows the state of a tape where a dot "•" is printed at the front end of the bottom left corner and two dots "••" are printed in a line near the rear end of the upper right corner. With this configuration, there are printed marks each at the front end of the bottom left corner and the rear end of the upper right corner of the tape T. It is thus possible to discriminate the front-and-rear of the tape T in the feeding direction thereof depending on the finding as to which of the two said marks has been detected, after the detection of the front end of the tape. In other words, after the detection of the front end of the tape, the user is allowed to discriminate the front-and-rear of the tape T promptly without waiting for the tape feeding at a given distance considering a possible detection error.

Figure 12C:
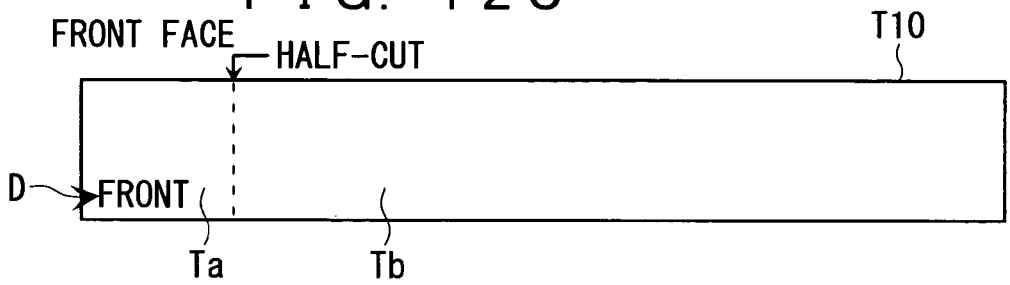

Further, as shown in FIG. 12C, let it be assumed that a tape T10 having a cut-off portion Ta therein is used. With respect to the non-information forming layer Ta, the substrate sheet in a strip shape (information forming layer) is previously half-cut in the width direction of the tape T either at a position near the front end or the rear end in the feeding direction thereof. Namely, when the label forming apparatus 1 has a configuration in which a strip tape with a half-cut is manually fed and the ink characters P are printed thereon, rather than that in which the ink characters P are printed on the tape T reeled out from the tape cartridge C, the cut-off portion Ta may have printed thereon the front-and-rear discriminating information D (in this case, character information representing "front" placed near the front end of the tape). With this configuration, the front-and-rear discriminating information D is printed in the cut-off portion Ta which is generally provided to facilitate the release of a releasing tape T2, thereby preventing the information recording portion Tb to be printed with ink characters from being damaged. Further, since the character information is printed as the front-and-rear discriminating information D, the front-and-rear of the tape T can be indicated more distinctly. Note that, when the apparatus has a configuration in which the cutting section 140 (see FIG. 6) is capable of half-cutting the tape into an elongated tape T, the front-and-rear discriminating information D may be printed in the cut-off portion Ta resulting from a half-cut formed on the elongated tape T. Note that the cutting section 140 is not the only thing that can perform half cutting. The braille embossing section 150 can also perform half-cutting before or after braille embossing. The apparatus may have an independent half-cutting mechanism.

Figure 12D:
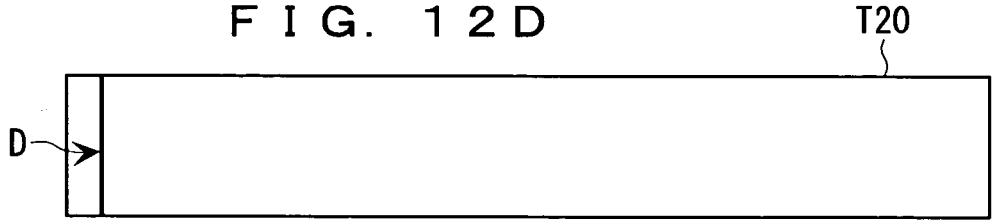

Further, differing from FIGS. 12A, 12B, and 12C in which the ink-characters printing section 120 prints the front-and-rear discriminating information D, there may be prepared a tape T20 as shown in FIG. 12D, which has previously printed thereon a line parallel to the tape width direction near the front end thereof. The line thus shows the front end of the tape T. With this configuration, it is unnecessary for the ink-characters printing section 120 to print front-and-rear discriminating information D. Note that another specific mark may previously be placed near the front or rear end of the tape T rather than in a line as in the case of the tape T20 as shown in the figure.

Figure 12E:
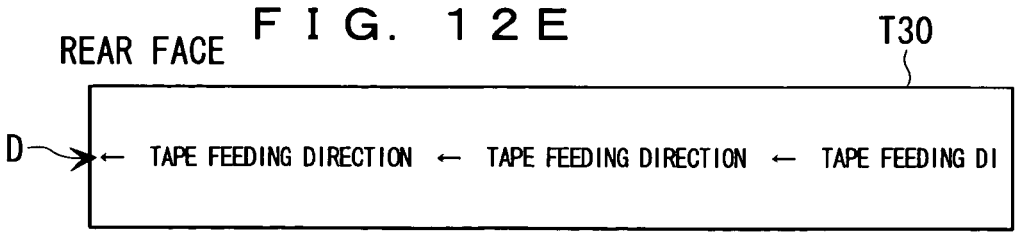

Further, as shown in FIG. 12E, there may be prepared a tape T30 whose rear face (released paper) has previously printed thereon a message for discriminating the front-and-rear (tape feeding direction) of the tape T. With this configuration, the front-and-rear of the tape T can specifically and distinctly be indicated, and the front face thereof is prevented from being damaged.

Figure 12F:
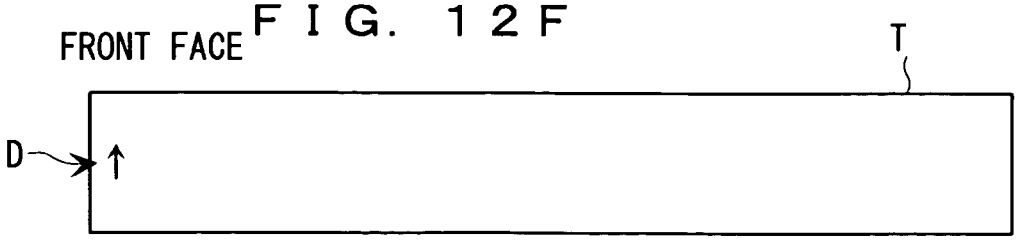

Further, as shown in FIG. 12F, there may be printed a mark for indicating ups-and-downs in the width direction of the tape T, rather than the one (a mark for) indicating the front-and-rear thereof (tape feeding direction) More specifically, the figure shows a state of the tape where an upwardly oriented arrow indicates an upward direction. In the label forming apparatus 1 of the present embodiment, the tape T is to be fed from the right side of the apparatus (see FIG. 1). Accordingly, the user can feed the tape T rightly in states where the front face of the tape T turns up and the oriented direction of the arrow indicates upward. Further, the direction of the arrow corresponds to the ups-and-downs of the tape T, thereby preventing the user from affixing the tape T upside down even if it is subjected to braille embossing only. Note that the front-and-rear discriminating sensor 92 is preferably arranged to match the position of the mark in the tape width direction. Further, besides the arrow mark, a dot "•" printed at the lower or upper end near the front end of the tape may be printed to indicate the ups-and-downs of the tape T.

Note that front-and-rear discriminating information D is not limited to either one of the examples as shown in FIGS. 12A to 12F. Namely, there may be stored a plurality of alternatives in the memory (ROM 220 etc.) from which a desirable front-and-rear discriminating information D may be selected by the user. In addition, there may be adopted an configuration in which the user operates the keyboard 3 to select the shape, the arrangement, or the number of the front-and-rear discriminating information D. However, to make it possible to arrange the front-and-rear discriminating information D in the tape width direction, it is necessary to have a plurality of front-and-rear discriminating sensors 92, or to enable the front-and-rear discriminating sensor 92 to move in the tape width direction.

As described above, according to the method of controlling a tape processing apparatus, the tape processing apparatus, and the program of the present invention, the embossing direction of braille data is changed based on the position of the defined braille embossing region Eb. Accordingly, the braille embossing region Eb in the width direction of the tape T can be defined according to the user's preference without making the embossing unit 80 capable of moving in the width direction of the tape traveling path 70.

Further, the tape T printed with ink characters has printed thereon the front-and-rear discriminating information D for discriminating the front-and-rear of the tape in the feeding direction thereof. Accordingly, when manually feeding the tape T into the braille embossing section 150, the user is prevented from feeding the same from the wrong side. Further, even if it is found impossible to discriminate ups-and-downs (front-and-rear) of the characters printed by ink-characters printing (i.e., a sign of arrow or a figure of zero), the front-and-rear discriminating information D is printed on the tape, thereby preventing the user from affixing the tape from the wrong side. Further, braille data is embossed in a state of being inverted in cases where the braille embossing region is defined under the basic layout structure and the tape is fed from the rear end thereof, or the braille embossing region is defined under the one opposite to the basic layout structure and the tape is fed from the front end thereof. Accordingly, even if the tape T is fed from the wrong side, braille can adequately be embossed in the defined braille embossing region Eb.

Figure 13:
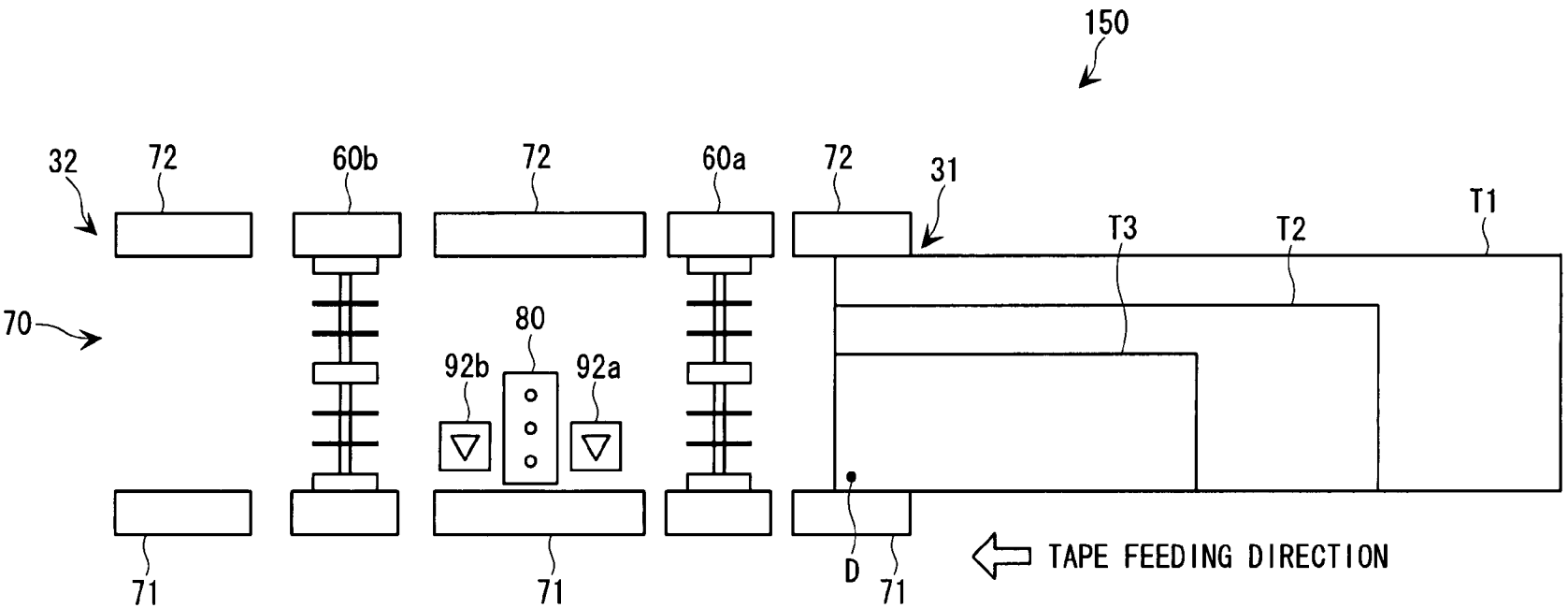
FIG. 13 is an illustration explaining another example around a tape traveling path in the braille embossing section.

In the above example, the members of the braille embossing section 150 are arranged from the embossing tape feeding port 31 side in the order of the embossing unit 80, the tape feeding mechanism 60, the front end detecting sensor 91, and the front-and-rear discriminating sensor 92 (see FIG. 5). Alternatively, as shown in FIG. 13A, the front-and-rear discriminating sensor 92 may be arranged either at the upstream side of the embossing unit 80 (92*a*) or between the embossing unit 80 and the tape feeding mechanism 60*b* (92*b*). In this case, however, the tape feeding mechanism 60*a* is needed at the upstream side of the front-and-rear discriminating sensors 92*a* and 92*b*. This is because an accurate detection (front-and-rear discrimination) cannot be performed unless the front end of the tape reaches the tape feeding mechanism 60*a*. In this manner, the front-and-rear discriminating sensor 92 is arranged at the further upstream side and the tape feeding mechanism 60*a* is provided, thus allowing the margin of the front end of the tape to be set short (the front margin does not have to be set longer than L2, the length extending between the embossing unit 80 and the feeding rollers 61).

Further, it is possible to have a configuration in which the front end detecting sensor 91 for detecting the front end of the tape T is omitted. In this case, however, after feeding the tape T until the front end thereof reaches the tape feeding mechanism 60*a* or 60*b*, the user depresses the feeding start key to feed the tape and detect front-and-rear discriminating information D. Based on the detected position of the front-and-rear discriminating information D, it is preferable for the user to depress the embossing start key to perform braille embossing and the tape feeding corresponding thereto. Further, after the completion of the embossing, it is possible to have a configuration in which the tape feeding mechanism 60*a* keeps on working while the user depresses the feeding start key to eject the tape T, rather than that in which a tape is fed at a given distance based on braille data. According to these configurations, the front end detecting sensor 91 can be omitted, thereby simplifying the apparatus in structure (control structure).

In addition, as shown in FIG. 1, the label forming apparatus 1 has the outer shape thereof formed by the apparatus casing 2, which is integrally formed by the front casing 2*a* having therein the ink-characters printing section 120 and the rear casing 2*b* having therein the braille embossing section 150. Alternatively, it is possible to have a configuration in which these casings serve as an independent apparatus, both of which can be connected to each other through an interface (connector). With this configuration, the apparatus equivalent to the rear casing 2*b* can be used, as an option, only by those who are required to perform braille embossing, and the apparatus equivalent to the rear casing 2*b* can be changed in shape. Accordingly, the apparatus (ink-characters printing apparatus) equivalent to the front casing 2*a* can be improved in versatility.

Further, the embossing unit 80 has one square in size where braille can be embossed, and three embossing pins 41 are provided therein (vertically-arranged three embossing points 201). Alternatively, the embossing unit 80 may have a size capable of performing simultaneous embossing of braille B in a plurality of lines. In other words, in the embossing unit where simultaneous embossing of braille can be performed in two lines, vertically-arranged six embossing pins are needed. With this configuration, the braille embossing region Eb can be defined in various ways. Further, when the embossing unit capable of performing simultaneous embossing of braille in two lines is used, two groups, each consisting of three embossing pins, can preferably be switched between the operating and non-operating mode. More specifically, when the embossing unit capable of performing simultaneous embossing of braille is used in "n" lines, "n" groups, each consisting of embossing pin(s), can preferably be either operable or non-operable. With this configuration, even the tape T with a width equal to or smaller than that of the embossing unit can be used.

Further, definition of the layout (see S14 of FIG. 7) of the ink-characters printing region Ep and the braille embossing region Eb may previously be performed by depressing the layout defining key, prior to the selection of the process mode (see S13 of FIG. 7). In this case, it is preferable to define a layout according to the width of tapes involved and is primarily determined by the detection of the tape width (see S11 of FIG. 7). With this configuration, it is possible to save labor of defining a layout for each ink-characters printing and/or braille embossing.

Further, definition of a layout is not limited to the examples as shown in FIGS. 9A to 9C. There may be various other alternatives such as one in which the ink-characters printing region Ep and the braille embossing region Eb partially overlap each other in the tape width direction, or one in which a blank is present in the boundary (in the tape width direction) between the ink-characters printing region Ep and the braille embossing region Eb. In this case as well, however, the braille embossing region Eb is defined at a position adjacent to one end in the width direction of the tape T (upper end or lower end). Based on the defined position and the arrangement of the embossing unit 80, the embossing control as shown in FIG. 10 is performed.

Further, the respective components (functions) of the label forming apparatus 1 shown in the foregoing examples can be provided as programs. They can be stored in a storage medium (not shown). The storage medium may be in the form of a CD-ROM, a flash ROM, a memory card (a compact flash (registered trademark), a smart media, a memory stick, etc.), a compact disk, a magnetic optical disk, a digital versatile disk, a flexible disk, etc.

The structure and the process steps in the label forming apparatus 1 may be modified as needed without departing from the spirit and scope of the present invention, without being bound by the examples as described above. The present invention is applicable not only to the label forming apparatus 1, but also to any other apparatus capable of performing braille embossing.

Next, a description will be made about a method of forming a label according to a second embodiment with reference to a screen display although it partially overlaps with the first embodiment in content.

The label forming apparatus 1 has three process modes. The user is to press the mode selecting key on the keyboard 3 to display a mode setting menu, in which one of "INK CHARACTERS ONLY," "BRAILLE ONLY," or "INK CHARACTERS AND BRAILLE IN COMBINATION" is selected according to the type of characters to be displayed on a label (see FIGS. 14A and 15).

Figure 14A:
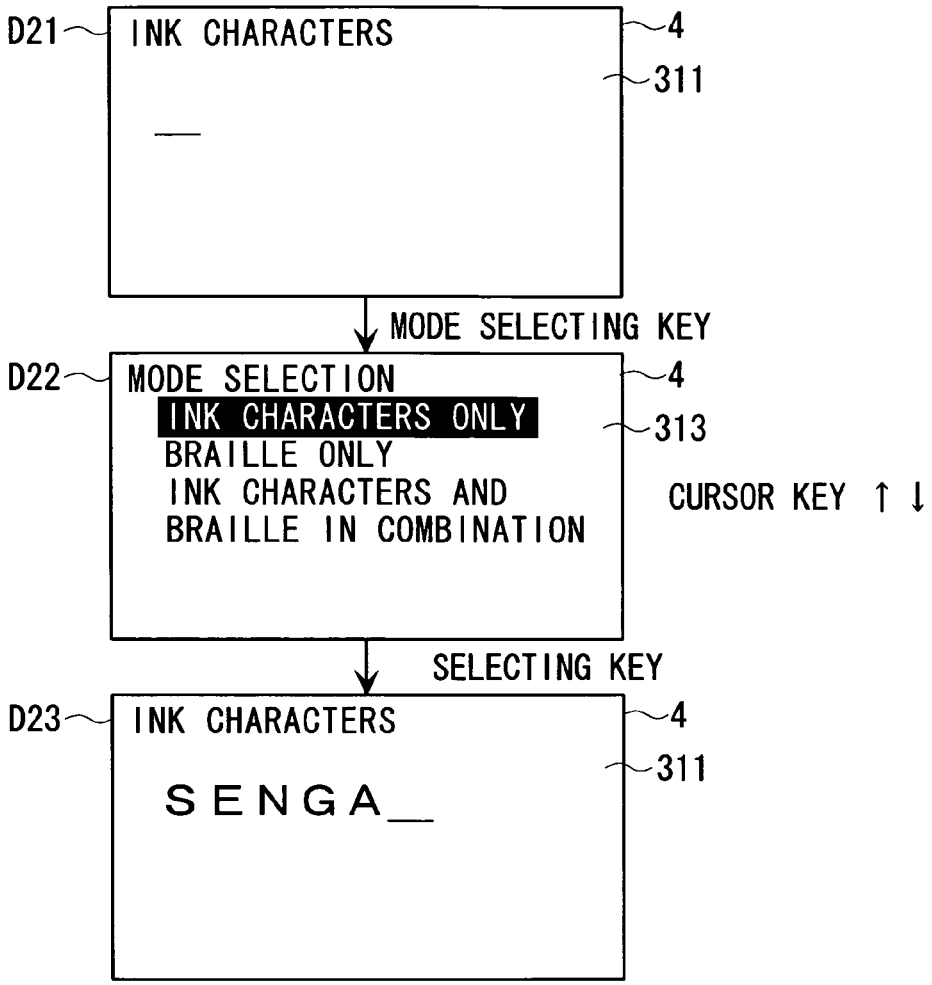
FIGS. 14A and 14B are illustrations when an "INK CHARACTERS ONLY" process mode is selected, each showing a screen transition on a display and an explanatory of ink-characters printing.
Figure 14B:
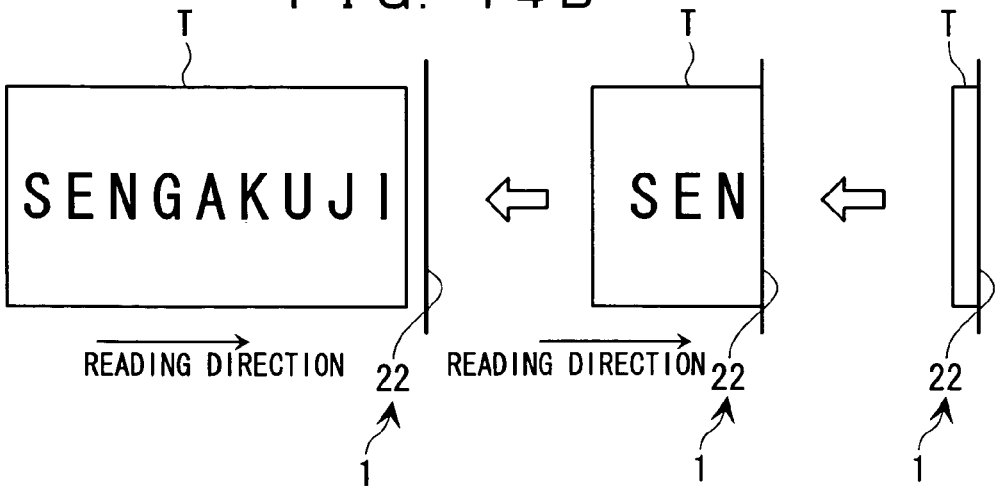

As shown in FIG. 14A, when the "INK CHARACTERS ONLY" is selected (defined) (D22), an ink-characters data inputting screen 311 appears on the display 4 (D23), where the user is allowed to input ink-characters data for generating ink-characters printing data. Ink-characters data are inputted in the same manner as they are with general word processors. When the user presses the printing key after inputting the ink-characters data (input data), the controlling section 200 generates label data (forward printing data, i.e., normal printing data) containing ink-characters printing data. As shown in FIG. 14B, the ink-characters printing section 120 is caused to operate based on the generated label data, and then ink characters are forwardly printed on the tape T one by one from the front end thereof in the reading direction ("SENGAKUJI" in FIG. 14B is the name of a famous Japanese temple). In addition, following the ink-characters printing, the cutting section 140 cuts off the tape T to form a label printed with ink characters only. Note that "INK CHARACTERS ONLY" is previously set to the initial settings of the process modes, and when the label forming apparatus 1 is started, for example, the ink-characters data inputting screen 311 (D21) appears.

Figure 15:
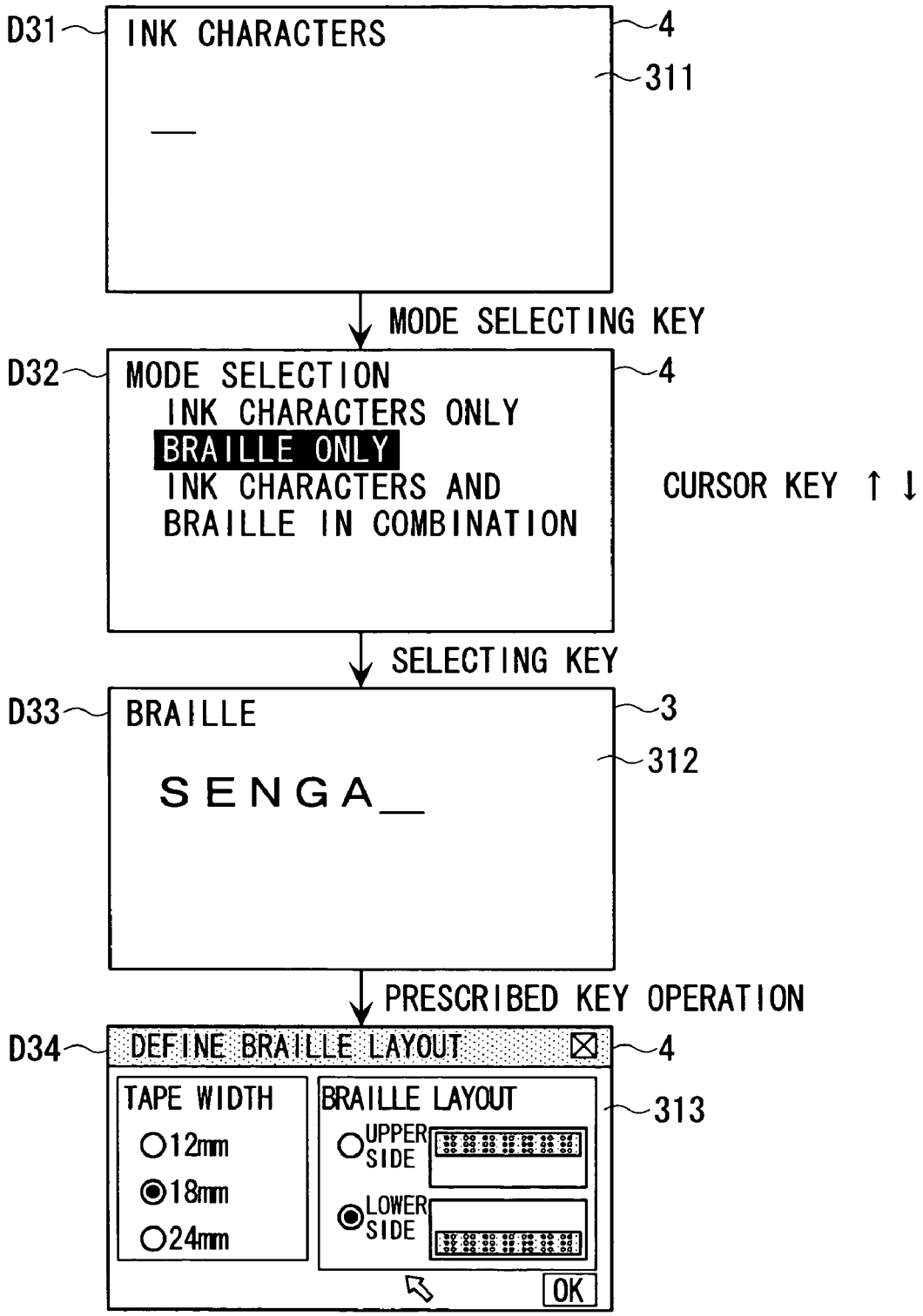
FIG. 15 is an illustration when a "BRAILLE ONLY" process mode is selected, showing a screen transition on a display.

As shown in FIG. 15, when the "BRAILLE ONLY" is selected (defined) (D32), braille-data inputting screen 312 appears on the display 4 (D33), which permits inputting of braille data to generate braille embossing data.

In this second embodiment, it is possible to generate two types of braille embossing data: one type for forward embossing data enabling the embossing unit 80 to forwardly emboss braille from the front end thereof in the reading direction, and the other type for reverse embossing data enabling the embossing unit 80 to reversely emboss forward embossing data which has been inverted. Thus, with respect to the tape T with a width of 18 mm or 24 mm toward which the embossing unit 80 is arranged at one side in the width direction, two types of braille layouts (braille embossing position for braille in the tape width direction) can be defined, thereby forming two types of labels: one in which braille is arranged at the upper side and the other in which braille is arranged at the lower side.

The braille embossing data also includes layout information regarding the width direction of the tape T, and the user selects and defines one of the two types of braille layouts. More specifically, when the user makes a prescribed key operation while the braille data inputting screen 312 is displayed, the screen switches to a braille layout defining screen 313 (D34), which allows for definition of a braille layout. On the braille layout defining screen 313 as shown in FIG. 15, the user selects a width and a braille layout of the tape T fed into the braille embossing section 150.

The width of the tape T can be selected from among alternatives of 12 mm, 18 mm, and 24 mm. Since a tape width detected by the above-described tape discriminating sensor 171 is previously set to the initial settings, however, this selection is available only when the tape T mounted on the ink-characters printing section 120 is not used. For definition of a braille layout, the user selects from either a "BRAILLE LAYOUT AT UPPER SIDE" in which braille is arranged at the upper side of the label or a "BRAILLE LAYOUT AT LOWER SIDE" in which braille is arranged at the lower side of the label. Each of the alternatives has an image view of a layout corresponding thereto. Referring to the image view of the layout, the user can select the braille layout. In the case of the tape T with a width of 12 mm, the user is not allowed to select a braille layout (since the alternatives are grayed out).

When the user manually feeds the tape T (tape member) into the embossing tape feeding port 31 and presses an embossing key after inputting braille data (input data), the controlling section 200 generates braille embossing data (label data). Then, the braille embossing section 150 embosses braille on the tape T based on the generated braille embossing data, to thereby form a label embossed in braille only.

Figure 16:
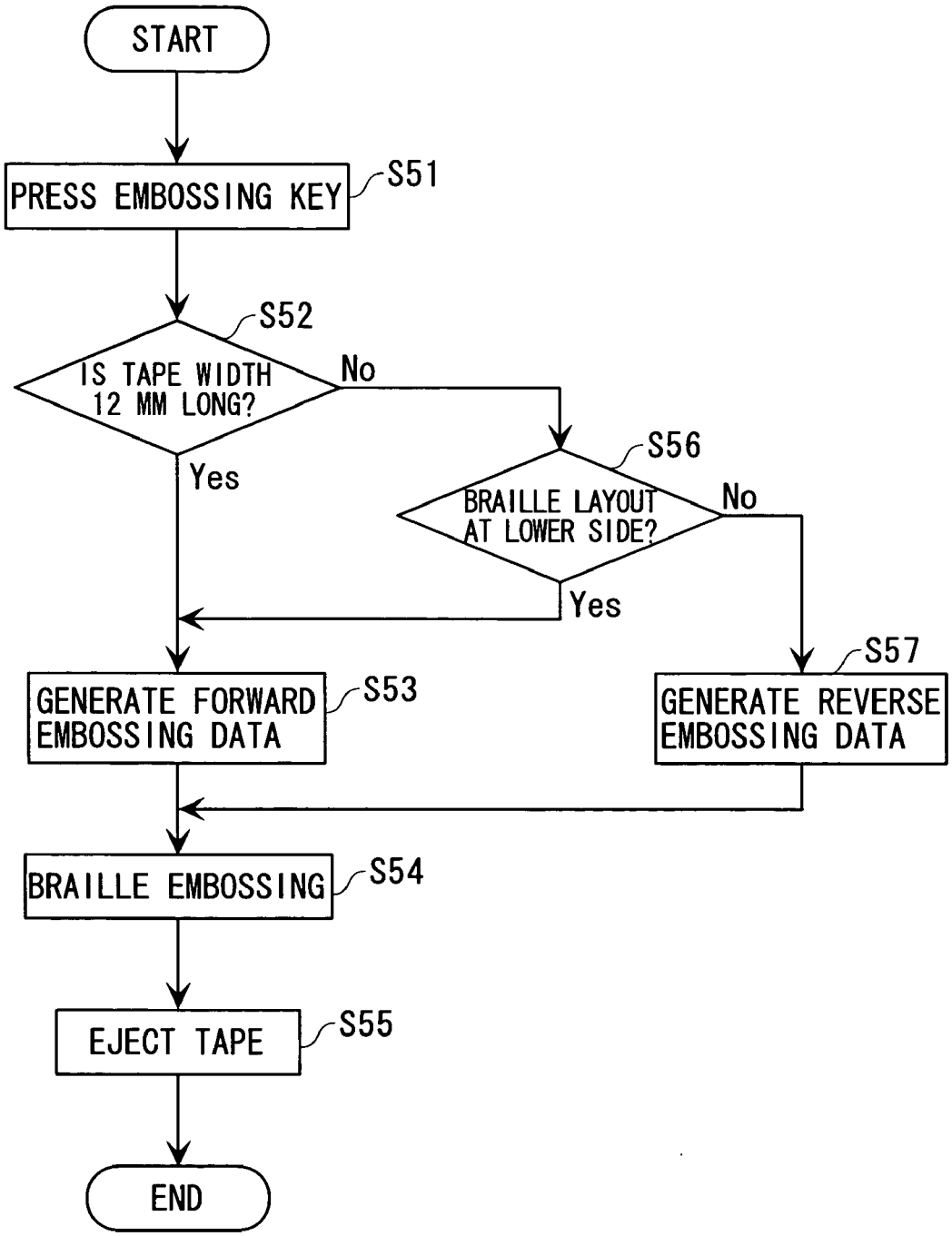
FIG. 16 is a controlling flow in braille embossing process.

FIG. 16 shows a controlling flow for the above-described situation. When the embossing key is pressed (S51) as shown in FIG. 16, the width of the defined tape T is first confirmed. At this time, when the detected width of the tape T is 12 mm long (S52: Yes), forward embossing data serving as braille embossing data is generated based on the inputted braille data (S53). While, when the detected width of the tape T is either 18 mm long or 24 mm long (S52: No), definition of a braille layout is further confirmed. When the "BRAILLE LAYOUT AT LOWER SIDE" is defined (S56: Yes), forward embossing data serving as braille embossing data is generated (S53). When the "BRAILLE LAYOUT AT UPPER SIDE" is defined (S56: No), reverse embossing data serving as braille embossing data is generated (S57).

In other words, braille embossing data is generated based on the defined braille layout (of a label). When one side in the width direction of the tape T, which faces the embossing unit 80, agrees in position with the braille layout in the width direction of the label, forward embossing data is generated. While, when the one side in the width direction of the tape T disagrees in position therewith, reverse embossing data is generated. For the sake of convenience, a description will specifically be made on the assumption that the near side of the tape traveling path 70 in the figure represents a lower side and the far side thereof an upper side. In the braille embossing section 150 of this second embodiment, the embossing unit 80 is arranged such that it faces the lower side of the tape T. In the case of the "BRAILLE LAYOUT AT LOWER SIDE," braille is arranged at the "LOWER SIDE" in the width direction of the label. The position in the width direction of the tape T, which the embossing unit 80 faces, agrees in position therewith, thereby generating forward embossing data. As opposite to this, in the case of the "BRAILLE LAYOUT AT UPPER SIDE," braille is arranged at the "UPPER SIDE" in the width direction of the label. The position in the width direction of the tape T, which the embossing unit 80 faces, disagree in position therewith, thereby generating reverse embossing data.

Figure 17A:
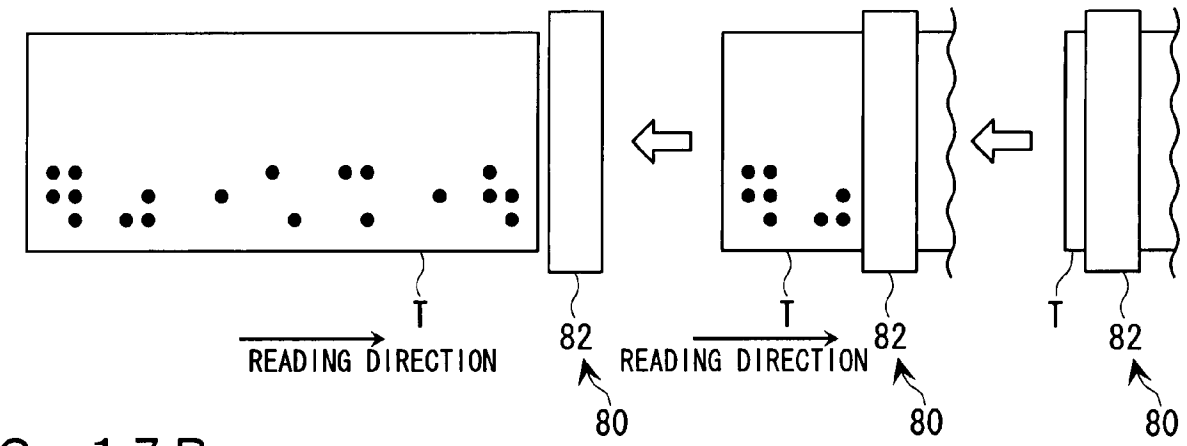
FIGS. 17A and 17B are illustrations of braille embossing process, each showing forward embossing and reverse embossing.
Figure 17B:
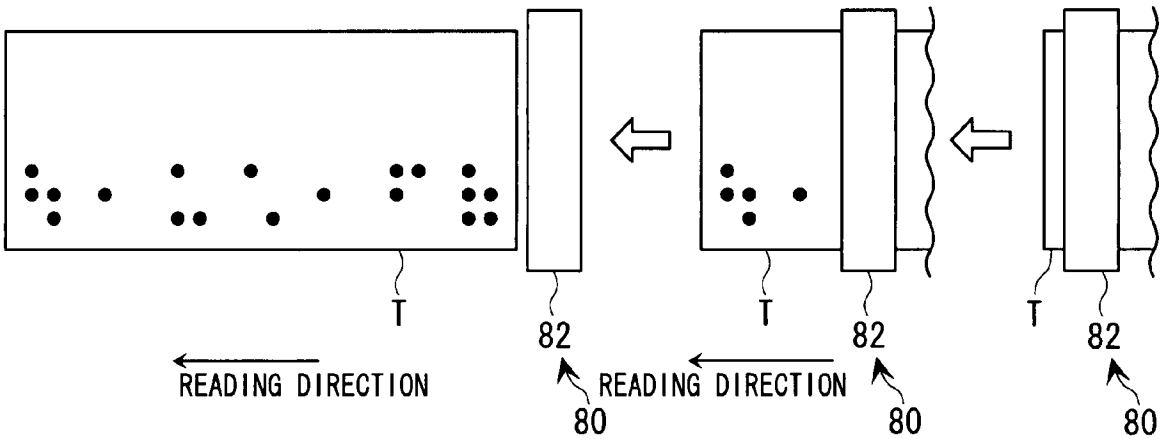

When either forward embossing data or reverse embossing data serving as braille embossing data is generated, the controlling section 200 thus causes the braille embossing section 150 to operate to emboss the tape T in braille (S54). As shown in FIG. 17A, where characters of "SENGAKUJI" are embossed in braille to form a label, for example, forward embossing is performed when forward embossing data is generated, with the characters being forwardly embossed from the front end thereof in the reading direction in the order of "SE," "N," "GA," "KU," and "JI." When reverse embossing data is generated as shown in FIG. 17B, on the other hand, reverse embossing is performed with braille being embossed in point-symmetry with the characters of the forward embossing. Namely, the characters in a state of being inverted are reversely embossed from the rear end thereof in the reverse-reading direction in the order of "JI," "KU," "GA," "N," and "SE" (Note that the braille in the drawing is expressed in accordance with the form of corresponding Japanese hiragana characters, not of alphabets).

When braille embossing on the tape T is finished, the controlling section 200 causes the tape T to be fed at a given distance through the braille embossing section 150 and the finished-tape T (label) to be ejected from the embossing-tape ejecting port 32 (S55). Note that, when reverse embossing is performed (based on reverse embossing data), since braille is embossed in point-symmetry with the characters of the forward embossing from the rear end thereof in the reading direction (based on the reverse embossing data), the ejected label is inverted for use.

Figure 18:
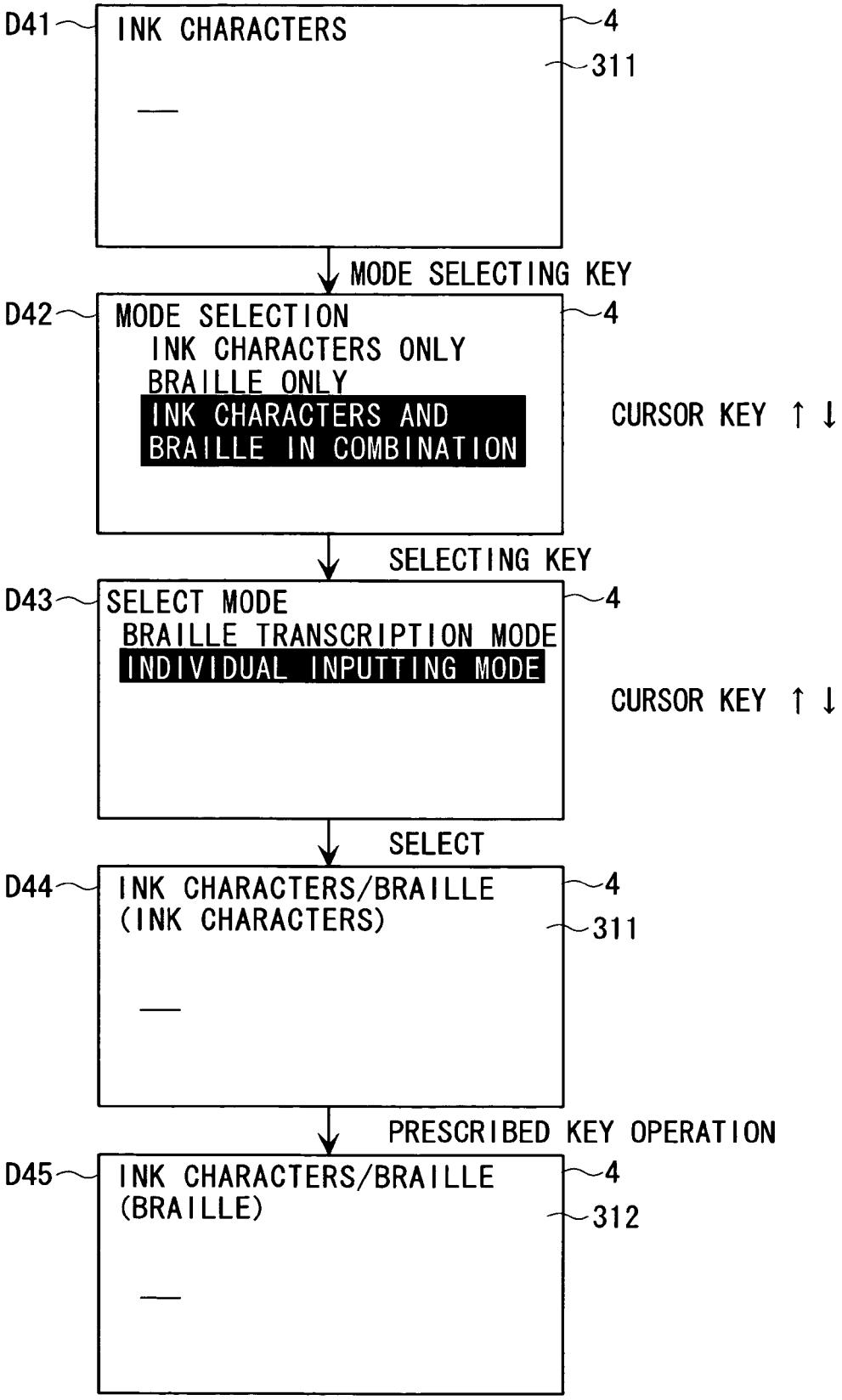
FIG. 18 is an illustration when an "INK CHARACTERS AND BRAILLE IN COMBINATION" process mode is selected, showing a screen transition on a display.

When the "INK CHARACERS AND BRAILLE IN COMBINATION" is selected (D42) as shown in FIG. 18, the screen then switches to a mode selecting screen (D43) which the user selects from either a "BRAILLE TRANSCRIPTION MODE" in which ink characters and braille are identical with each other in content or an "INDIVIDUAL INPUTTING MODE" in which ink characters and braille are different from each other in content. When the "BRAILLE TRANSCRIPTION MODE" is selected, an ink-characters data inputting screen 311 appears, and braille data is generated based on the ink-characters data (text data) inputted on the ink-characters data inputting screen 311. While, when the "INDIVIDUAL INPUTTING MODE" is selected, the ink-characters data inputting screen 311 appears (D44). In this case, the user makes a prescribed key operation to switch from the ink-characters data inputting screen 311 to a braille data inputting screen 312 (D45) for inputting braille one after the other, allowing for inputting both ink-characters data and braille data.

Further, in the process mode of the "INK CHARACTERS AND BRAILLE IN COMBINATION" as shown in FIG. 19, there is arranged a layout defining menu for defining a layout of ink characters and braille, where the user can selects from either "INK CHARACTERS AND BRAILLE IN PARALLEL" in which ink characters and braille are arranged in parallel with each other or "INK CHARACTERS AND BRAILLE OVERLAPPED" in which ink characters and braille overlap each other. When the "INK CHARACTERS AND BRAILLE IN PARALLEL" is selected, other alternatives subsequently appear, which allows the user to select from either "INK CHARACTERS AT UPPER SIDE and BRAILLE AT LOWER SIDE" in which ink characters (ink-characters printing region) and braille (braille embossing region) are respectively arranged at the upper and lower sides of the label, or "BRAILLE AT UPPER SIDE and INK CHARACTERS AT LOWER SIDE" in which braille (braille embossing region) and ink characters (ink-characters printing region) are respectively arranged at the upper and lower sides of the label. While, when the "INK CHARACTERS AND BRAILLE OVERLAPPED" is selected when the tape T with a width of 18 mm or 24 mm is detected, a braille layout can be defined as in the case where a braille layout is defined under the "BRAILLE ONLY" process mode.

Figure 20:
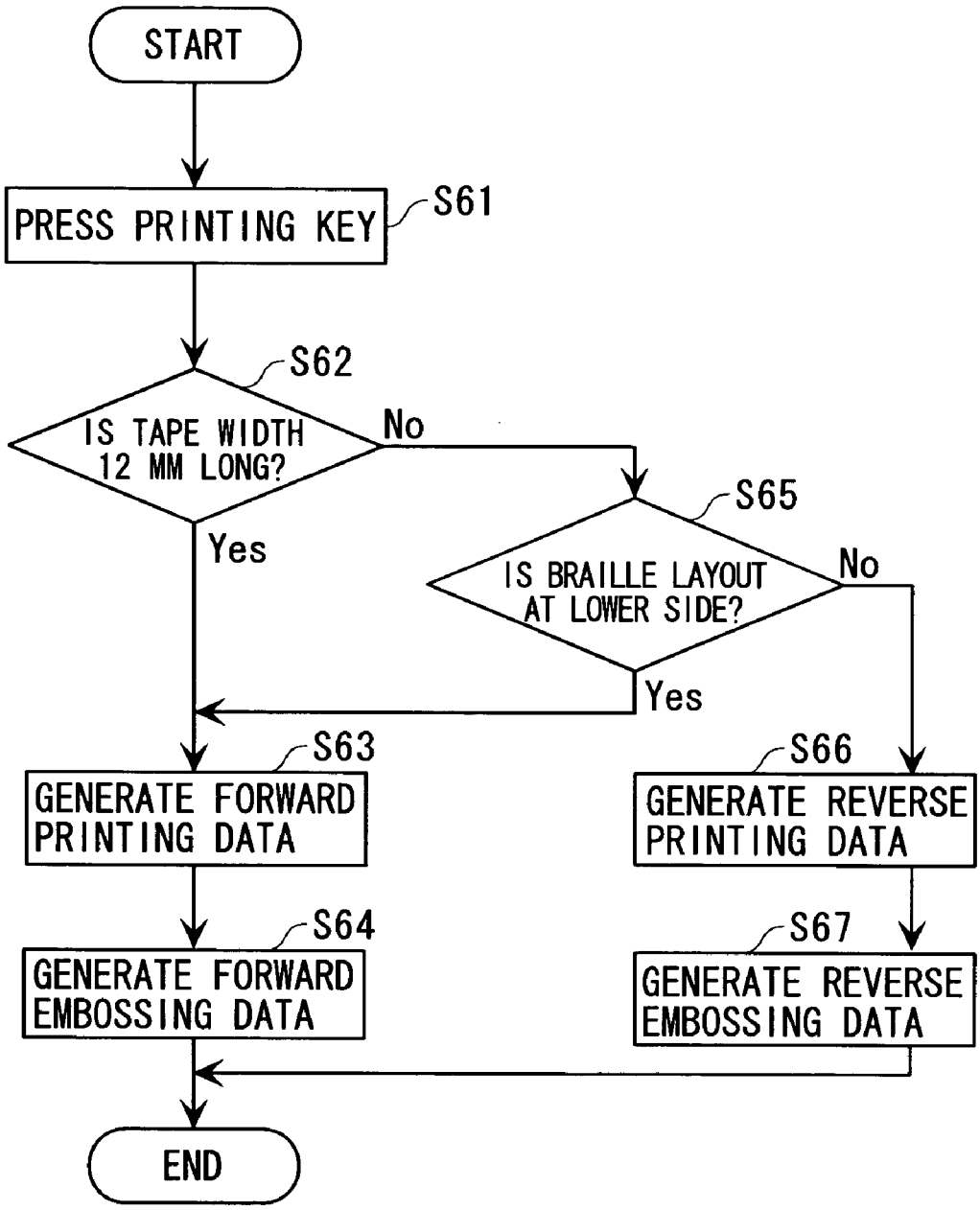
FIG. 20 is a controlling flow for forming label data when the "INK CHARACTERS AND BRAILLE IN COMBINATION" process mode is selected.

When the user presses the printing key after inputting input data, label data is first generated based on the input data. FIG. 20 shows a controlling flow for generating label data. When the printing key is pressed (S61) as shown in the figure, the width of the defined tape T is first confirmed. At this time, when the width of the tape T detected by the tape discriminating sensor 171 is 12 mm long (S62: Yes), forward printing data serving as ink-characters printing data is generated to cause ink-characters to be printed from the front end thereof in the reading direction (S63). Following the generation of the forward printing data, forward embossing data serving as braille embossing data is generated (S64).

When the width of the detected tape T is either 18 mm long or 24 mm long (S65: No), definition of a braille layout is further confirmed. When the braille is arranged at the lower side of the label (S65: Yes), i.e., when the "INK CHARACTERS AT UPPER SIDE AND BRAILLE AT LOWER SIDE" is selected in the "INK CHARACTERS AND BRAILLE IN PARALLEL" of the layout defining menu, or when the "BRAILLE LAYOUT AT LOWER SIDE" in the "INK CHARACERS AND BRAILLE OVERLAPPED" is selected, forward printing data is generated (S63) and then forward embossing data is generated (S64) as in the case of the tape with a width of 12 mm. While, when the braille is arranged at the upper side of the label (S65: No), i.e., when the "BRAILLE AT UPPER SIDE AND INK CHARACTERS AT LOWER SIDE" is selected in the "INK CHARACTERS AND BRAILLE ARRANGED IN PARALLEL" of the layout defining menu, or when the "BRAILLE LAYOUT AT UPPER SIDE" in the "INK CHARACTERS AND BRAILLE OVERLAPPED" is selected, reverse printing data (which is generated with forward printing data being inverted) is generated, causing ink characters to be printed from the rear end of the label in the reading direction, in the reverse reading direction and in point-symmetry with the characters of the forward printing (S66), and then the reverse embossing data is generated (S67).

Besides the above-described braille data, ink-characters printing data is also generated based on the defined braille layout (of the label). Braille embossing data is defined, as in the case of the "BRAILLE ONLY" process mode, depending on whether or not one side in the width direction of the tape T, which the embossing unit 80 faces, agrees in position with a braille layout in the width direction of the label. In this case, since forward embossing process and reverse embossing process have an opposite processing direction relative to the label, the directions to manually feed the tape T into the braille embossing section 150 are just the opposite for forward embossing and reverse embossing.

Figure 21A:
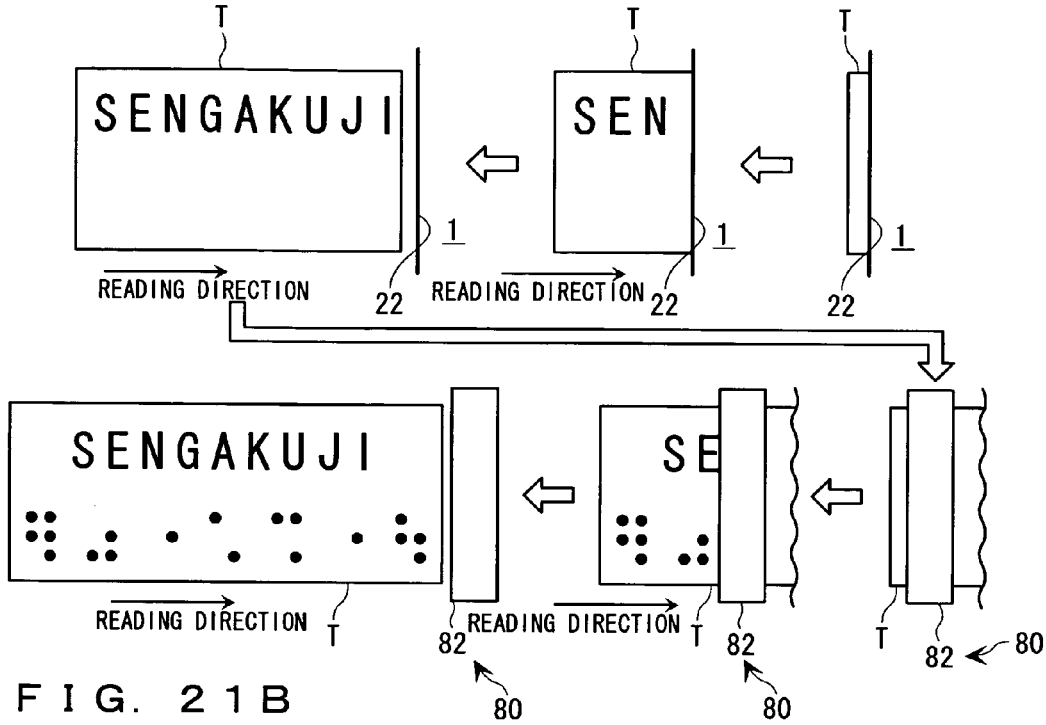
FIGS. 21A and 21B are successive flows for generating label data when the "INK CHARACTERS AND BRAILLE IN COMBINATION" process mode is selected, each showing states of forward printing and forward embossing and states of reverse printing and reverse embossing.
Figure 21B:
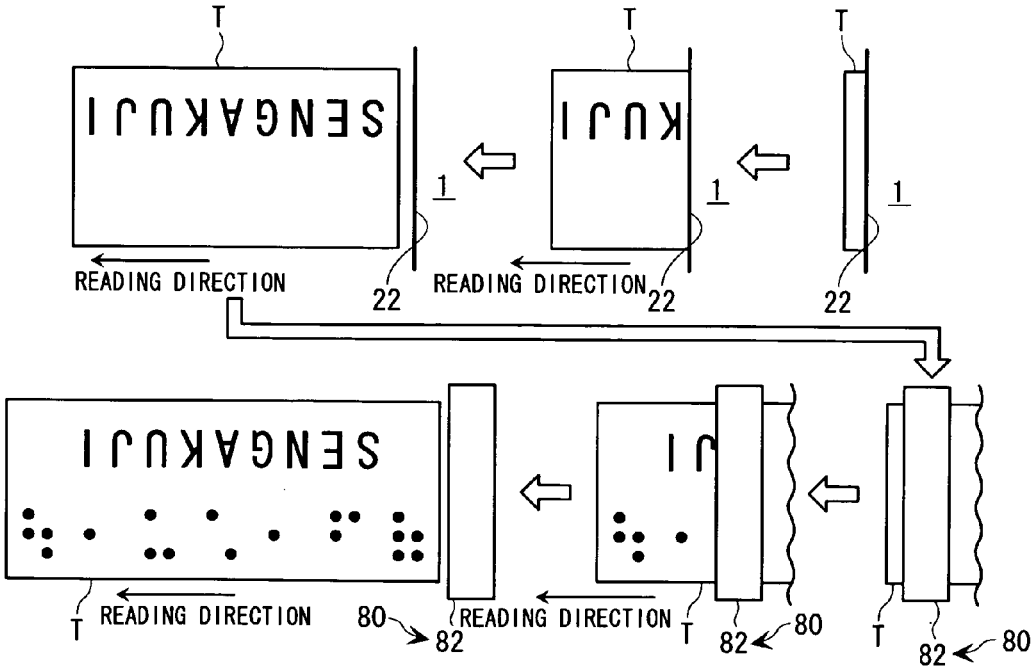

When forward embossing data is to be generated in this embodiment, forward printing data is previously generated. While, when reverse embossing data is to be generated, reverse printing data is previously generated. As shown in FIGS. 21A and 21B, the process directions of the tape T in the ink-characters printing and braille embossing are identical with each other. Accordingly, the tape T (tape member) ejected from the printing-tape ejecting port 22 of the ink-characters printing section 120 is directly and manually fed from the front end thereof into the braille tape feeding port 31 of the braille embossing section 150. In other words, to place the tape T at the braille embossing section 150, the user may just feed manually into the embossing tape feeding port 31 of the braille embossing section 150 the tape T (tape member) which has been ejected from the printing-tape ejecting port 22 along the process direction. It is to be noted that, in the example of FIGS. 21A and 21B as well as in FIGS. 22A and 22B, the ink-characters printing is shown in alphabets (SENGAKUJI), while the braille embossing correspond to hiragana, not to the alphabets. This is partly to avoid the use of language other than alphabets where possible.

Also in this embodiment, the ink-characters printing section 120 is designed to be capable of printing on the tape T index information G for indexing a manual feeding direction, thus allowing the user to clearly discriminate the direction of manual feeding relative to the braille embossing section 150. More specifically, there is arranged an index print setting menu for setting whether or not an index should be printed when the "INK CHARACTERS AND BRAILLE IN COMBINATION" the process mode is selected. When it is determined that an index is printed, the controlling section 200 (index-information-data generating means) generates index information data for causing the ink-characters printing section 120 to print index information G before braille embossing data is generated (at S64 or S67).

Figure 22A:
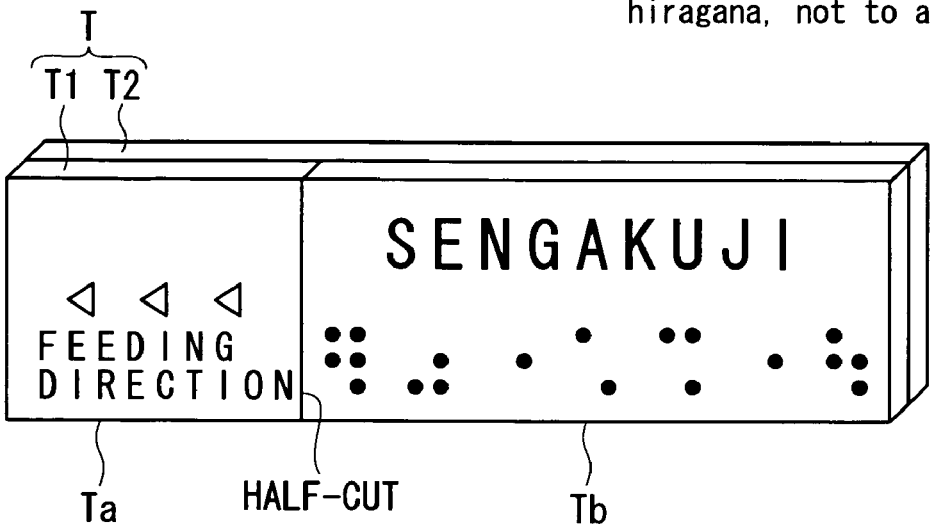
FIGS. 22A and 22B are exemplified labels printed with an index, each showing a drawing of an index printing indexing a manual feeding direction for forward embossing and a drawing of an index printing indexing thereof for reverse embossing.
Figure 22B:
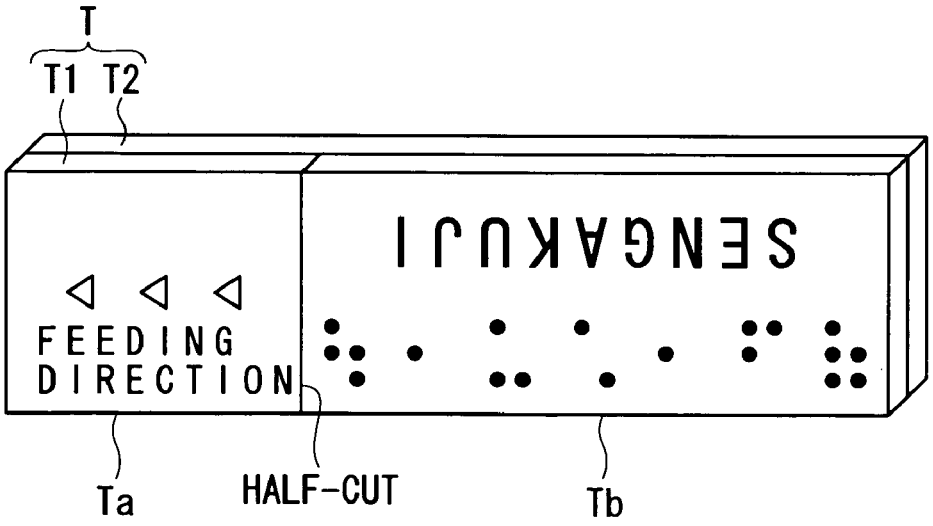

An index printing process is performed before ink characters printing process with the index printing process being performed at the front end of the tape T in the feeding direction thereof by the ink-characters printing section 120. In other words, index information G is printed at the front end of the tape T in the manual feeding direction thereof relative to the braille embossing section 150. As shown in FIGS. 22A and 22B, index information G is printed at the front end of a label for forward printing or at the rear end thereof for reverse printing.

This embodiment is so designed that half-cut data can also be generated (as label data) to separate a cut-off portion Ta serving as an area where index information is printed. The tape T1 printed with ink characters and embossed in braille has a half-cut (at a given position thereof) to separate the cut-off portion Ta from an information recording portion Tb. By dint of half-cutting, it is possible not only to easily separate the recording tape T1 serving as the information recording portion Tb from the releasing tape T2, but also to dispose the cut-off portion Ta, thereby contributing to a pleasing appearance of the label. Note that the index printing process should preferably be implemented based on the user's settings, which may include arranging an index print setting menu.

As described above, the label forming apparatus 1 is configured with the present invention. Accordingly, even in a case where the embossing unit 80 fixed in position is used, the user is allowed to select from two different braille layouts of which braille is arranged at the upper or lower side in the width direction of the tape, and to properly select either of them according to intended purpose of the label involved.

Note that the present invention is not limited to the above-described embodiment. Rather, it may be modified where necessary without departing from the spirit and scope thereof. For example, when the embossing unit 80 is arranged at the "UPPER" side of the tape T, forward embossing data is generated for the "BRAILLE LAYOUT AT UPPER SIDE" and reverse embossing data for the "BRAILLE LAYOUT AT LOWER SIDE."

Further, in the present embodiment, the present invention is applied to the label forming apparatus which causes the tape T to be fed along one side of the embossing unit 80 fixed in position. Also applied is a configuration in which the embossing unit 80 makes a relative motion in the width direction of the tape traveling path 70.

Assuming that there is provided a unit moving mechanism (not shown) which causes the embossing unit 80 to move in the width direction of the tape, the present invention is applied to the label forming apparatus causing the embossing unit 80 to move in the width direction of the tape relative to the tape T being fed along the tape traveling path 70. Thus, there can be provided a label forming apparatus which is small in size and capable of embossing braille over the whole width of the tape T. In other words, forward embossing data or reverse embossing data is generated based on the defined braille layout to have a configuration which causes the embossing unit 80 to move across one side in the width direction of the tape T, thereby allowing braille to be embossed over the whole width of the tape T.

In this case, when the braille layout in the width direction of the label (the braille embossing position in the width direction of the tape) is arranged at the same side as the embossing unit 80, i.e., at the half-side of the tape T, which the embossing unit 80 faces, forward embossing data is generated. While, when the braille layout is arranged at the side opposite to the embossing unit 80, i.e., at the other half-side of the tape T, which the embossing unit 80 does not face, reverse embossing data is generated. Similarly, the present invention can be applied to a label forming apparatus capable of (moving the embossing tape feeding port 31 etc.) defining the manual feeding position of the tape T in the width direction thereof relative to the embossing unit 80 fixed in position.

What is claimed is:

1. A method of controlling a tape processing apparatus where braille is embossed at one side in the width direction of a tape with an embossing means arranged at the one side while the tape is being fed along a tape traveling path, the method comprising:

an embossing-position defining step of defining a braille embossing position in the width direction of the tape;

an embossing-data generating step of generating embossing data for embossing the braille, based on input information and the defined braille embossing position; and a braille embossing step of embossing the braille on the tape based on the generated embossing data; wherein, in the embossing-data generating step, when the defined braille embossing position is arranged at one side in the width direction of the tape on the same side as the embossing means, the embossing data is generated such that braille is forwardly embossed one by one from the front end thereof in the reading direction, and when the defined braille embossing position is arranged at the other side in the width direction of the tape opposite to the embossing means, the embossing data is generated such that inverted braille is reversely embossed one by one from the rear end thereof in the reading direction.

2. The method of controlling a tape processing apparatus according to claim 1, wherein the tape has printed thereon front-and-rear discriminating information for discriminating the front-and-rear thereof in a feeding direction.

3. The method of controlling a tape processing apparatus according to claim 2, further comprising a front-and-rear detecting step of detecting the front-and-rear of the tape fed into the tape traveling path, based on the front-and-rear discriminating information, wherein, in the braille embossing step, the braille is prevented from being embossed under conditions where, in the embossing-data generating step, the embossing data is generated such that braille is forwardly embossed and in the front-and-rear detecting step, the tape is detected to be fed from the rear end thereof in the reading direction, and in the embossing-data generating step, the embossing data is generated such that braille is reversely embossed, and in the front-and-rear detecting step, the tape is detected to have been fed from the front end thereof in the reading direction.

4. The method of controlling a tape processing apparatus according to claim 1, further comprising:

a printing-data generating step of generating printing data for printing ink characters on the tape, based on the input information and the defined braille embossing position; and an ink-characters printing step of printing ink characters on the tape with a printing means based on the generated printing data, prior to the braille embossing step, wherein, in the printing-data generating step, when the defined braille embossing position is arranged at one side in the width direction of the tape on the same side as the embossing means, the printing data is generated such that ink characters are forwardly printed one by one from the front end-thereof in the reading direction, and when the defined braille embossing position is arranged at the other side in the width direction of the tape opposite to the embossing means, the printing data is generated such that inverted ink-characters are reversely printed one by one from the rear end thereof in the reading direction.

5. A tape processing apparatus where braille is embossed at one side in a width direction of a tape while the tape is being fed along a tape traveling path, the apparatus comprising:

an embossing means arranged at one side in the width direction of the tape, for embossing braille at the one side;

an embossing-position defining means for defining a braille embossing position in the width direction of the tape;

an embossing-data generating means for generating embossing data based on input information and the defined braille embossing position; and an embossing controlling means for controlling the embossing means based on the generated embossing data; wherein, with the embossing-data generating means, when the defined braille embossing position is arranged at one side in the width direction of the tape on the same side as the embossing means, the embossing data is generated such that braille is forwardly embossed one by one from the front end thereof in the reading direction, and when the defined braille embossing position is arranged at the other side in the width direction of the tape opposite to the embossing means, the embossing data is generated such that inverted braille is reversely embossed one by one from the rear end thereof in the reading direction.

6. The tape processing apparatus according to claim 5, wherein the tape has printed thereon front-and-rear discriminating information for discriminating the front-and-rear thereof in a feeding direction.

7. The tape processing apparatus according to claim 6, further comprising a front-and-rear detecting means for detecting the front-and-rear of the tape fed into the tape traveling path based on the front-and-rear discriminating information, wherein, with the embossing controlling means, the braille is prevented from being embossed under conditions where the embossing-data generating means generates the embossing data such that braille is forwardly embossed, and the front-and-rear detecting means detects that the tape is fed from the rear end thereof in the reading direction, and the embossing-data generating means generates the braille data such that the braille is reversely embossed, and the front-and-rear detecting means detects that the tape is fed from the front end thereof in the reading direction.

8. The tape processing apparatus according to claim 5, further comprising:

a printing means for printing ink characters on the tape, prior to braille embossing with the embossing means;

a printing-data generating means for generating printing data for printing ink characters, based on the input information and the defined braille embossing position;

a printing controlling means for controlling the printing means, based on the generated printing data; wherein, with the printing-data generating means, when the defined braille embossing position is arranged at one side in the width direction of the tape on the same side as the embossing means, the printing data is generated such that ink characters are forwardly printed one by one from the front end thereof in the reading direction, and when the defined braille embossing position is arranged at the other side in the width direction of the tape opposite to the embossing means, the printing data is generated such that inverted ink-characters are reversely printed one by one from the rear end thereof in the reading direction.

9. The tape processing apparatus according to claim 8, wherein the tape traveling path comprises a traveling path for printing along which the tape is fed and printed with ink characters and a traveling path for embossing along which the tape is fed and embossed in braille, and the traveling path for embossing is manually fed with the tape having passed through the traveling path for printing.

10. A computer readable medium which stores a program which causes a computer to perform each of the means of the tape processing apparatus as described in any one of claims 5 to 9.

* * * * *